United States Patent [19]

Nakajima et al.

[11] Patent Number: 4,741,311

[45] Date of Patent: May 3, 1988

[54] METHOD OF AIR/FUEL RATIO CONTROL FOR INTERNAL COMBUSTION ENGINE

[75] Inventors: Toyohei Nakajima; Yasushi Okada; Toshiyuki Mieno; Nobuyuki Oono, all of Wako, Japan

[73] Assignee: Honda Giken Kogyo Kabushiki Kaisha, Tokyo, Japan

[21] Appl. No.: 42,371

[22] Filed: Apr. 24, 1987

[30] Foreign Application Priority Data

Apr. 24, 1986 [JP] Japan ..... 61-096033
Apr. 30, 1986 [JP] Japan ..... 61-100383

[51] Int. Cl.[4] ..... F02M 51/00

[52] U.S. Cl. ..... 123/489; 123/492; 123/493

[58] Field of Search ..... 123/438, 440, 489, 492, 123/493

[56] References Cited

U.S. PATENT DOCUMENTS 4,467,770 8/1984 Arimura et al. ..... 123/489
4,542,729 9/1985 Yamato et al. ..... 123/489 X
4,572,129 2/1986 Otobe ..... 123/492 X
4,578,172 3/1986 Yamada et al. ..... 123/489 X
4,592,325 6/1986 Nakagawa ..... 123/489
4,633,840 1/1987 Saito et al. ..... 123/492 X
4,635,200 1/1987 Egami et al. ..... 123/492 X
4,637,364 1/1987 Abe et al. ..... 123/492

*Primary Examiner*—Willis R. Wolfe
*Attorney, Agent, or Firm*—Birch, Stewart, Kolasch & Birch

[57] ABSTRACT

A method of engine air/fuel ratio control whereby a compensation value is computed for compensating an error of a basic fuel injection time interval. The computation is periodically performed as an operating sequence including steps of computing a current first compensation value, utilizing a preceding first compensation value (obtained and memorized during a previous execution of the sequence, under the same engine operating conditions as those of the current first computation value), obtaining a second compensation value based on the deviation between a detected air/fuel ratio and a target air/fuel ratio, and compensating the basic value by the first and second compensation values to obtain an output value, used to control fuel supply to the engine. In addition, while engine acceleration or deceleration is occurring, the basic value is corrected by a transition compensation value, computed in accordance with the degree of acceleration or deceleration.

8 Claims, 17 Drawing Sheets

| FIG. 3a | FIG. 3b |
|---|---|

$K_{O2}$ COMPUTATION SUBROUTINE
61
ACTIVATION COMPLETED ?
YES
NO
62
SET $T_{WO2}$ IN ACCORDANCE WITH $T_A$
63
SET TARGET AIR/FUEL RATIO $AF_{TAR}$
64
READ IN $I_P$
65
SEARCH FOR DETECTED AIR/FUEL RATIO $AF_{ACT}$
66
$14.2 \leq AF_{TAR} \leq 15.2$
YES
NO

| FIG. 5a | |
|---|---|
| FIG. 5b | |

109
$K_{O2Pn} = K_{OP} \cdot \Delta AFn$
110
SEARCH FOR $K_{OI}$
111
READ OUT $K_{O2I(n-1)}$
112
$K_{O2In} = K_{O2I(n-1)} + K_{OI} \cdot \Delta AFn$
113
READ OUT $\Delta AF_{(n-1)}$
114
$K_{O2Dn} = K_{OD}(\Delta AF_{(n-1)} - \Delta AFn)$
115
$K_{O2} = K_{O2Pn} + K_{O2In} + K_{O2Dn}$
116
$|AF_{ACT} - AF_{TAR}| \leq 0.5$
NO
YES
117
$K_{O2} = K_1$
118
$(-1)^n > 0$
NO
YES
119
$K_{O2} = K_{O2} + P_1$
120
$K_{O2} = K_{O2} - P_1$
RETURN

METHOD OF AIR/FUEL RATIO CONTROL FOR INTERNAL COMBUSTION ENGINE

BACKGROUND OF THE INVENTION

1. Field of the Invention

The present invention relates to a method of air/fuel ratio control for an internal combustion engine.

2. Description of Background Information

In order to reduce the level of exhaust gas pollutants and improve the fuel consumption of an internal combustion engine, it is known to employ an oxygen concentration sensor to detect the concentration of oxygen in the engine exhaust gas, and to execute feedback control of the air/fuel ratio of the mixture supplied to the engine such as to hold the air/fuel ratio at a target value. This feedback control is performed in accordance with an output signal from the oxygen concentration sensor.

One type of oxygen concentration sensor which can be employed for such air/fuel ratio control produces an output which varies substantially in proportion to the oxygen concentration in the engine exhaust gas. Such an oxygen concentration sensor has been disclosed for example in Japanese patent laid-open No. 52-72286, which consists of an oxygen ion-conductive solid electrolytic member formed as a flat plate having a pair of electrodes respectively formed on two main faces, with one of these electrode faces forming part of a gas holding chamber. The gas holding chamber communicates with a gas which is to be measured, i.e. exhaust gas, through a lead-in aperture. With such an oxygen concentration sensor, the oxygen ion-conductive solid electrolytic member and its pair of electrodes function as an oxygen pump element. By passing a flow of current between the electrodes such that the electrode within the gas holding chamber becomes a negative Electrode. Oxygen gas within the gas holding chamber adjacent to this negative electrode becomes ionized, and flows through the solid electrolytic member towards the positive electrode, to be thereby emitted from that face of the pump element as gaseous oxygen. The current flow between the electrodes reaches a boundary current value which is substantially unaffected by variations in the applied voltage, and is substantially proportional to the oxygen concentration within the gas under measurement. Thus, by sensing the level of this boundary current, it is possible to measure the oxygen concentration within the gas which is under measurement. However, if such an oxygen concentration sensor is used to control the air/fuel ratio of the mixture supplied to an internal combustion engine, by measuring the oxygen concentration within the engine exhaust gas, then it will only be possible to control the air/fuel ratio to a value which is in the lean region, relative to the stoichiometric air/fuel ratio. It is not possible to perform air/fuel ratio control to maintain a target air/fuel ratio which is set in the rich region. An oxygen concentration sensor which will provide an output signal level varying substantially in proportion to the oxygen concentration in engine exhaust gas for both the lean region and the rich region of the air/fuel ratio has been proposed in Japanese patent laid-open No. 59-192955. This sensor consists of two oxygen ion-conductive solid electrolytic members each formed as a flat plate, and each provided with a pair of electrodes. Two opposing electrode faces, i.e. one face of each of the solid electrolytic members, form part of a gas holding chamber which communicates with a gas under measurement, via a lead-in aperture. The other electrode of one of the solid electrolytic members faces into the atmosphere. In this oxygen concentration sensor, one of the solid electrolytic members and its pair of electrodes functions as an oxygen concentration ratio sensor cell element. The other solid electrolytic member and its pair of electrodes function as an oxygen pump element. If the voltage which is generated between the electrodes of the oxygen concentration ratio sensor cell element is higher than a reference voltage value, then current is supplied between the electrodes of the oxygen pump element such that oxygen ions flow through the oxygen pump element towards the electrode of the element which is within the gas holding chamber. If the voltage developed between the electrodes of the sensor cell element is lower than the reference voltage value, then a current is supplied between the electrodes of the oxygen pump element such that oxygen ions flow through that element towards the oxygen pump element electrode which is on the opposite side to the gas holding chamber. In this way, a value of current flow between the electrodes of the oxygen pump element is obtained which varies substantially in proportion to the oxygen concentration of the gas under measurement, both in the rich and lean regions of the air/fuel ratio.

When such an oxygen concentration sensor which produces an output varying substantially in proportion to oxygen concentration is used for air/fuel ratio control, then a basic value for air/fuel ratio control is established in accordance with engine operating parameters relating to engine load (e.g. the pressure within the intake pipe, etc.) in the same way as for a prior art type of oxygen concentration sensor whose output is not proportional to oxygen concentration. Compensation of the basic value with respect to a target air/fuel ratio is performed in accordance with the output from the oxygen concentration sensor, to thereby derive an output value, and the air/fuel ratio of the mixture supplied to the engine is controlled by this output value. However with an oxygen concentration sensor producing an output proportional to oxygen concentration, the degree of oxygen concentration in the engine exhaust gas can be obtained from the output of the sensor. It is therefore desirable to employ an air/fuel ratio control method with such a sensor which will provide more accurate control of the air/fuel ratio than has been possible with prior art types of oxygen concentration sensor which do not produce an output proportional to the oxygen concentration. In particular, it has been hitherto extremely difficult to attain a high degree of accuracy of air/fuel ratio control during transitional engine operation such as acceleration or deceleration, due to the large fluctuations which occur in the air/fuel ratio as a result of delays in control response.

SUMMARY OF THE INVENTION

It is an objective of the present invention to provide an improved method of air/fuel ratio control for an internal combustion engine, employing an oxygen concentration sensor which produces an output varying substantially in proportion to oxygen concentration, whereby a greater degree of control of accuracy of air/fuel ratio can be attained than has been possible hitherto, and whereby improved engine performance and more effective elimination of exhaust pollutants can be obtained during engine acceleration or deceleration.

According to a first aspect, an air/fuel ratio control method according to the present invention, employing an oxygen concentration sensor for sensing the concentration of oxygen in the exhaust gas of an engine, comprises setting a basic value ($T_i$) for control of the engine air/fuel ratio, in accordance with a plurality of engine operating parameters relating to engine load, and periodically executing at predetermined intervals a sequence of operations comprising:

detecting said air/fuel ratio of the mixture based upon the oxygen concentration sensor output;

computing a current first compensation value ($K_{REF}$) for compensating an error of the basic value, utilized in the computation of a preceding first compensation value computed during a previous execution of the sequence of operations in which the operating region of the engine was substantially identical to the operating region during computation of the current first compensation value, where the operating region is determined in accordance with the aforementioned plurality of engine operating parameters;

computing a deviation from a target air/fuel ratio of an air/fuel ratio detected by utilizing the output of the oxygen concentration sensor, and compensating the deviation by the current first compensation value and the preceding first compensation value to obtain a second compensation value ($K_{O2}$);

computing an output value ($T_{OUT}$), determined with respect to the target air/fuel ratio, by a process which comprises compensating the basic value by the current first compensation value and the second compensation value, and;

controlling the air/fuel ratio of the mixture supplied to the engine in accordance with the output value.

According to a second aspect, with an air/fuel ratio control method according to the present invention, when engine acceleration or deceleration is detected, a transition compensation value is set in accordance with the degree of acceleration or deceleration, and the basic value is compensated by this transition compensation value to thereby determine the output value. In addition, when acceleration or deceleration is detected, the transition compensation value is compensated by a second compensation value, which is obtained in accordance with the deviation from a targer air/fuel ratio of an air/fuel ratio detected from the output of the oxygen concentration sensor.

BRIEF DESCRIPTION OF THE DRAWINGS

FIGS. 4, 4*a*, 4*b* and 4*c*, 5, 5*a* and 5*b*, 7, 7*a*, 7*b*, and 7*c*, and 11, 12, 13, 13*a*, and 13*b* are flow charts for assistance in describing the operation of a CPU;

DETAILED DESCRIPTION OF EMBODIMENTS

Figure 1:
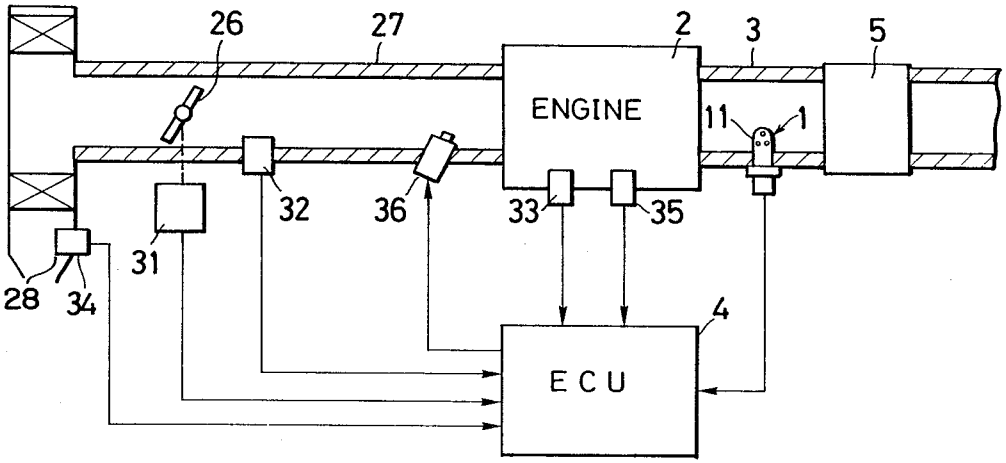
FIG. 1 is a diagram showing an electronic control fuel injection apparatus equipped with an oxygen concentration sensor, suitable for application of the air/fuel ratio control method of the present invention.
Figure 2:
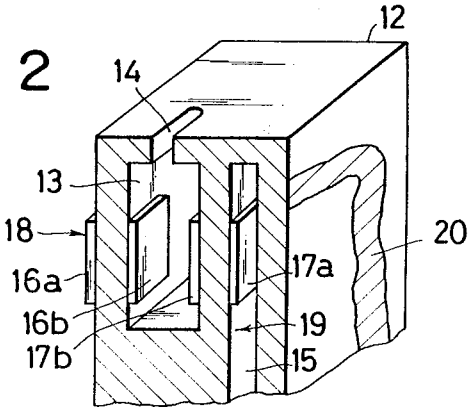
FIG. 2 is a diagram for illustrating the internal configuration of an oxygen concentration sensor detection unit.
Figures 3, 3A:
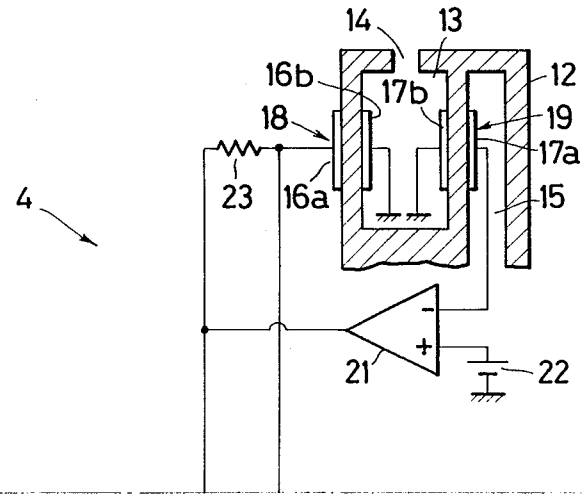
FIGS. 3, 3*a*, and 3*b* are block circuit diagrams of the interior of an ECU (Electronic Control Unit)
Figure 3B:
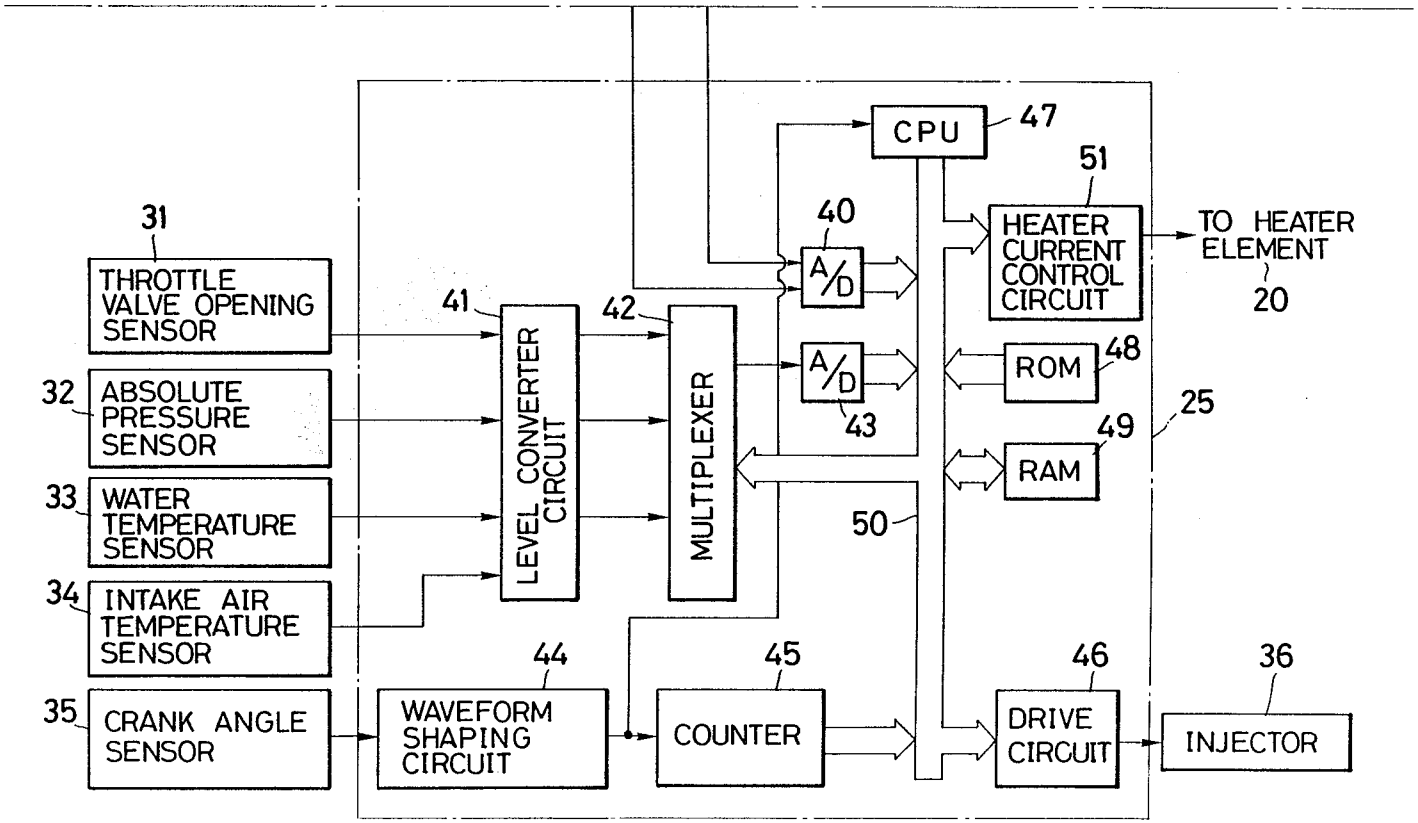

An embodiment of the present invention will now be described, referring to the drawings. FIGS. 1 through 3 show an electronic fuel control apparatus which utilizes the air/fuel ratio control method of the present invention. In this apparatus, an oxygen concentration sensor detection unit 1 is mounted within an exhaust pipe 3 of an engine 2, upstream from a three way catalytic converter 5. Inputs and outputs of the oxygen concentration sensor detection unit 1 are coupled to an ECU (Electronic Control Unit) 4.

A protective case 11 covers the oxygen concentration sensor detection unit 1 which contains an oxygen ion-conductive solid electrolyte member 12 having a substantially rectangular shape of the form shown in FIG. 2. A gas holding chamber 13 is formed in the interior of the solid electrolyte member 12, and communicates with exhaust gas via a lead-in aperture 14 at the exterior of the solid electrolytic member 12, constituting a gas to be sampled. The lead-in aperture 14 is positioned such that the exhaust gas will readily flow from the interior of the exhaust pipe into the gas holding chamber 13. In addition, an atmospheric reference chamber 15 is formed within the solid electrolytic member 12, into which atmospheric air is led. The atmospheric reference chamber 15 is separated from the gas holding chamber 13 by a portion of the solid electrolytic member 12 serving as a partition. As shown, pairs of electrodes 17*a*, 17*b* and 16*a*, 16*b* respectively sandwich the side walls of the chamber 13 while facing each other. The solid electrolytic member 12 functions in conjunction with the electrodes 16*a* and 16*b* as an oxygen pump element 18, and functions in conjunction with electrodes 17*a*, 17*b* as a sensor cell element 19. A heater element 20 is mounted on the external surface of the atmospheric reference chamber 15.

The oxygen ion-conductive solid electrolyte member 12 is formed of $ZrO_2$ (zirconium dioxide), while the electrodes 16*a* through 17*b* are each formed of platinum.

As shown in FIG. 3, ECU 4 includes an oxygen concentration sensor control section, consisting of a differential amplifier 21, a reference voltage source 22, and resistors 23. Electrode 16*b* of the oxygen pump element 18 and electrode 17*b* of sensor cell element 19 are each connected to ground potential. Electrode 17*a* of sensor cell element 19 is connected to an input of differential amplifier 21, which produces an output voltage in accordance with the difference between the voltage appearing between electrodes 17*a*, 17*b* and the output voltage of reference voltage source 22. The output voltage of voltage source 22 corresponds to the stoichiometric air/fuel ratio, i.e. 0.4 V. The output terminal of differential amplifier 21 is connected through the current sensing resistor 23 to electrode 16*a* of the oxygen pump element 18. The terminals of current sensing resistor 23 constitute the output terminals of the oxygen concentration sensor, and are connected to the control circuit 25, which is implemented as a microprocessor.

A throttle valve opening sensor 31 which produces an output voltage in accordance with the degree of opening of throttle valve 26, and can be implemented as a potentiometer, is coupled to control circuit 25. Control circuit 25 is also connected an absolute pressure sensor 32 which is mounted in intake pipe 27 at a position downstream from the throttle valve 26 and produces an output voltage varying in level in accordance with the absolute pressure within the intake pipe 27. A water temperature sensor 33 produces an output voltage varying in level in accordance with the temperature of the engine cooling water, an intake temperature sensor 34 is mounted near an air intake aperture 28 and produces an output at a level which is determined in accordance with the intake air temperature, and a crank angle sensor 35 generates signal pulses in synchronism with the rotation of the crankshaft (not shown in the drawings) of engine 2 are also connected to control circuit 25. Moreover, an injector 36 is connected to control circuit 25 and is mounted on intake pipe 27 near the intake valves (not shown in the drawing) of engine 2.

Control circuit 25 includes an A/D converter 40 which receives the voltage developed across the current sensing resistor 23 as a differential input and converts that voltage to a digital signal. Control circuit 25 also includes a level converter circuit 41 which performs a level conversion of each of the output signals from the throttle valve opening sensor 31, the absolute pressure sensor 32, and the water temperature sensor 33 and the intake temperature sensor 34. The resultant level-converted signals from level converter circuit 41 are supplied to the inputs of multiplexer 42. Control circuit 25 also includes an A/D converter 43 which converts the output signals from multiplexer 42 to digital form, a waveform shaping circuit 44 which executes waveform shaping of the output signal from the crank angle sensor 34 to produce TDC (top dead center) output signal pulses, and a counter 45 which counts a number of clock pulses (produced from a clock pulse generating circuit which is not shown in the drawings) during each interval between successive TDC pulses from the waveform shaping circuit 44. Control circuit 45 further includes a drive circuit 46 for driving the injector 36, a CPU (central processing unit) 47 for performing digital computation in accordance with a program and a ROM (read-only memory) 48 having various processing programs and data stored therein, and a RAM (random access memory) 49. The A/D converters 40 and 43, multiplexer 42, counter 45, drive circuit 46, CPU 47, ROM 48 and RAM 49 are mutually interconnected by an input/output bus 50. The TDC signal is supplied from the waveform shaping circuit 44 to the CPU 47. The control circuit 25 also includes a heater current supply circuit 51, which can, for example, include a switching element that is responsive to a heater current supply command from CPU 47 for applying a voltage between the terminals of heater element 20, to thereby supply a heater current and allow the heater element 20 to produce heat. RAM 49 is a non-volatile type of back-up memory, whose contents are not erased when the engine ignition switch (not shown in the drawings) is turned off.

Data representing a pump current value $I_P$ and corresponding to the current flow through the oxygen pump element 18, transferred from A/D converter 40, together with data representing a degree of throttle valve opening $O_{th}$, data representing the absolute pressure $P_{BA}$ within the intake pipe, and data representing the cooling water temperature $T_W$ and intake air temperature $T_A$, respectively selected and transferred by A/D converter 43, are supplied to CPU 47 over the I/O bus 50. In addition, a count value from counter 45, which is attained during each period of the TDC pulses, is also supplied to CPU 47 over I/O bus 50. The CPU 47 executes a read-in of all of the data in accordance with a processing program which is stored in the ROM 48, and computes a fuel injection time interval $T_{OUT}$ for injector 36 on the basis of the data, in accordance with a fuel injection quantity for engine 2 which is determined from predetermined equations. This computation is performed by means of a fuel supply routine, which is executed in synchronism with the TDC signal. The injector 36 is then actuated by drive circuit 46 for the duration of the fuel injection time interval $T_{OUT}$, to supply fuel to the engine 2.

The fuel injection time interval $T_{OUT}$ can be obtained for example from the following equation:

$$T_{OUT}=T_i\times K_{O2}\times K_{REF}\times K_{WOT}\times K_{TW}+T_{ACC}+T_{DEC} \quad (1)$$

In the above equation, $T_i$ is a basic value for air/fuel ratio control, which constitutes a basic injection time and is determined by searching a data map stored in ROM 48, in accordance with the engine speed of rotation $N_e$ and the absolute pressure $P_{BA}$ in the intake pipe. $K_{O2}$ is a feedback compensation coefficient for the air/fuel ratio, and is set in accordance with the output signal level from the oxygen concentration sensor. $K_{REF}$ is a learning control compensation coefficient, and is determined by searching a data map stored in RAM 49 in accordance with the engine speed $N_e$ and an absolute pressure $P_{BA}$ within the intake pipe. $K_{WOT}$ is a fuel quantity increment compensation coefficient, and is applied when the engine is operating under a high load. $K_{TW}$ is a cooling water temperature coefficient. $T_{ACC}$ is an acceleration increment value, and $T_{DEC}$ is a deceleration decrement value. $T_i$, $K_{O2}$, $K_{REF}$, $K_{WOT}$, $K_{TW}$, $T_{ACC}$ and $T_{DEC}$ are respectively set by a subroutines of a fuel supply routine.

When the supply of pump current to the oxygen pump element 18 begins, if the air/fuel ratio of the mixture that is supplied to engine 2 at that time is in the lean region, then the voltage that is produced between electrodes 17a and 17b of the sensor cell element 19 will be lower than the output voltage from the reference voltage source 22, and as a result the output voltage level from the differential amplifier 21 will be positive. This positive voltage is applied across the series-connected combination of resistor 23 and oxygen pump element 18. A pump current thereby flows from electrode 16a to electrode 16b of the oxygen pump element 18, so that the oxygen within the gas holding chamber 13 becomes ionized by electrode 16b, and flows through the interior of oxygen pump element 18 from electrode 16b, to be ejected from electrode 16a as gaseous oxygen. Oxygen is thereby drawn out of the interior of the gas holding chamber 13.

As a result of this withdrawal of oxygen from the gas holding chamber 13, a difference in oxygen concentration will arise between the exhaust gas within gas holding chamber 13 and the atmospheric air within the atmospheric reference chamber 15. A voltage $V_S$ is thereby produced between electrodes 17a and 17b of the sensor cell element 19 at a level determined by this difference in oxygen concentration, and the voltage $V_S$ is applied to the inverting input terminal of differential amplifier 21. The output voltage from differential amplifier 21 is substantially proportional to the voltage difference between the voltage $V_S$ and the voltage produced from reference voltage source 22, and hence the pump current is proportional to the oxygen concentration within the exhaust gas. The pump current value is output as a value of voltage appearing between the terminals of the current sensing resistor 23.

When the air/fuel ratio is within the rich region, the voltage $V_S$ will be higher than the output voltage from the reference voltage source 22, and hence the output voltage from the differential amplifier 21 will be inverted from a positive to a negative level. In response to this negative level of output voltage, the pump current which flows between electrodes 16a and 16b of the oxygen pump element 18 is reduced, and the direction of current flow is reversed. Thus, since the direction of the pump current flow is now from the electrode 16b to electrode 16a, oxygen will be ionized at electrode 16a, so that oxygen will be transferred as ions through oxygen pump element 18 to electrode 16b, to be emitted as gaseous oxygen within the gas holding chamber 13. In this way, oxygen is drawn into gas holding chamber 13. The supply of pump current is thereby controlled to maintain the oxygen concentration within the gas holding chamber 13 at a constant value, by drawing oxygen into or out of chamber 13, so that the pump current $I_P$ will always be substantially proportional to the oxygen concentration in the exhaust gas, for operation in both the lean and rich regions of the air/fuel ratio. The value of the feedback compensation coefficient $K_{O2}$ referred to above is established in accordance with the pump current value $I_P$, in a $K_{O2}$ computation subroutine.

The operating sequence of CPU 47 for the $K_{O2}$ computation subroutine will now be described, referring to the flow chart of FIGS. 4a and 4b.

Figures 4, 4A, 4B, 4C:
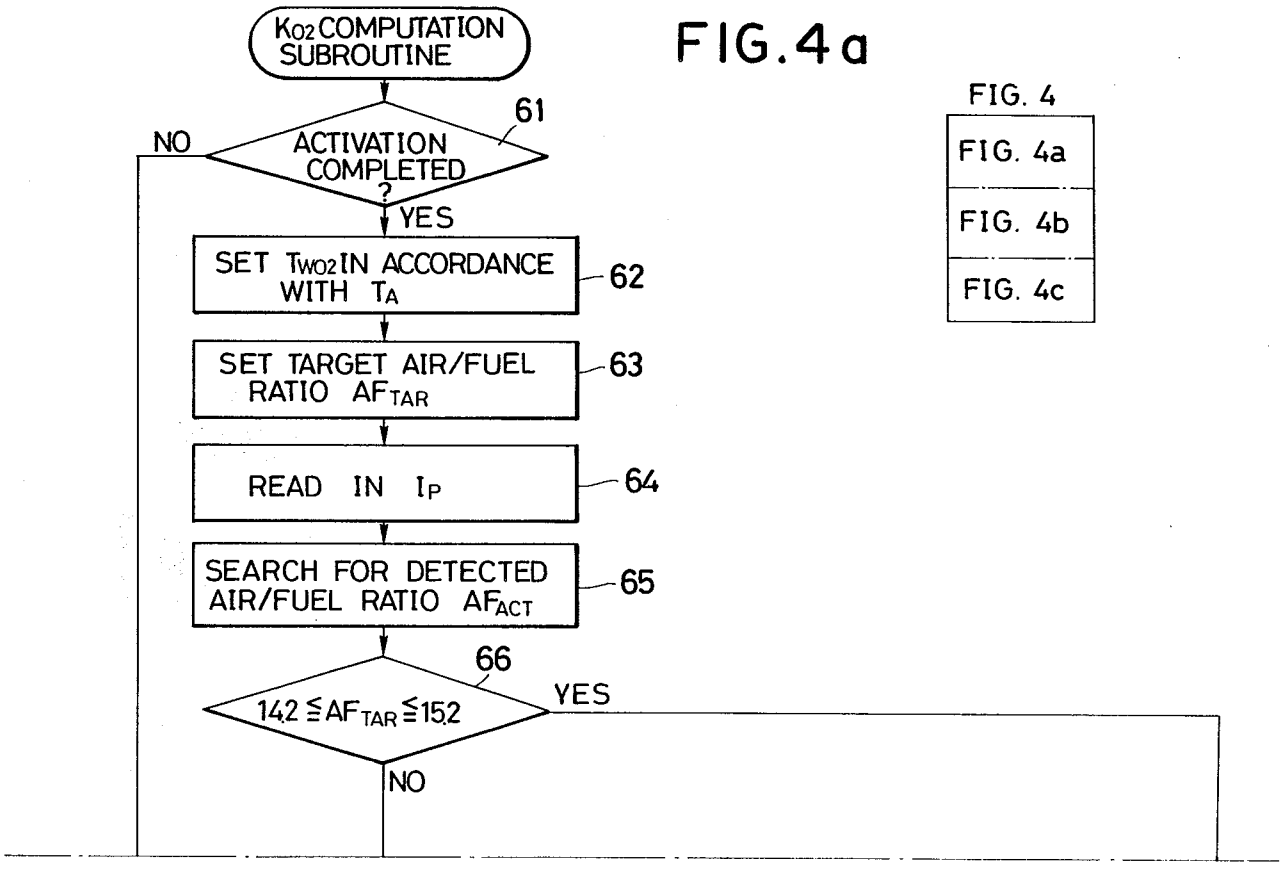
Figure 4B:
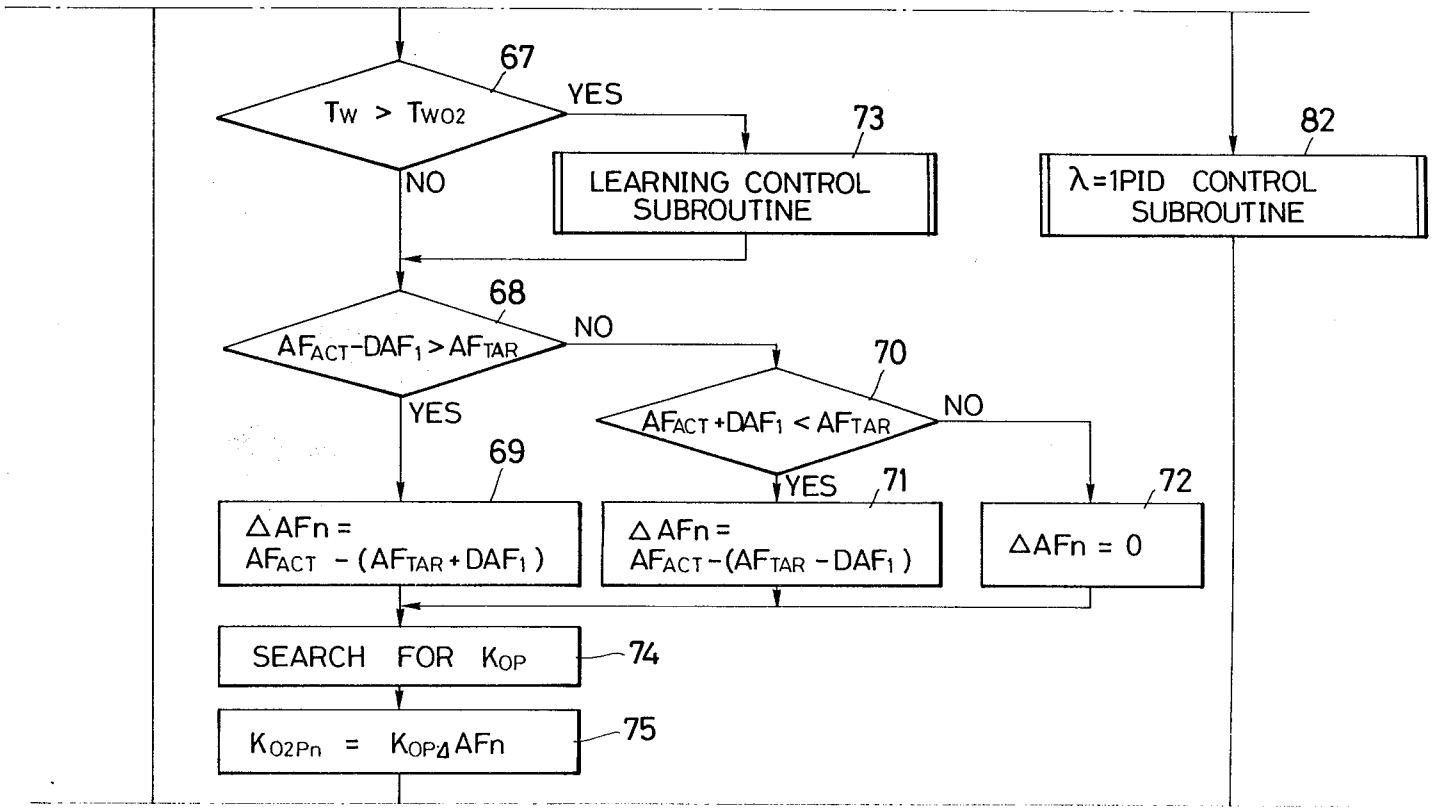
Figure 4C:
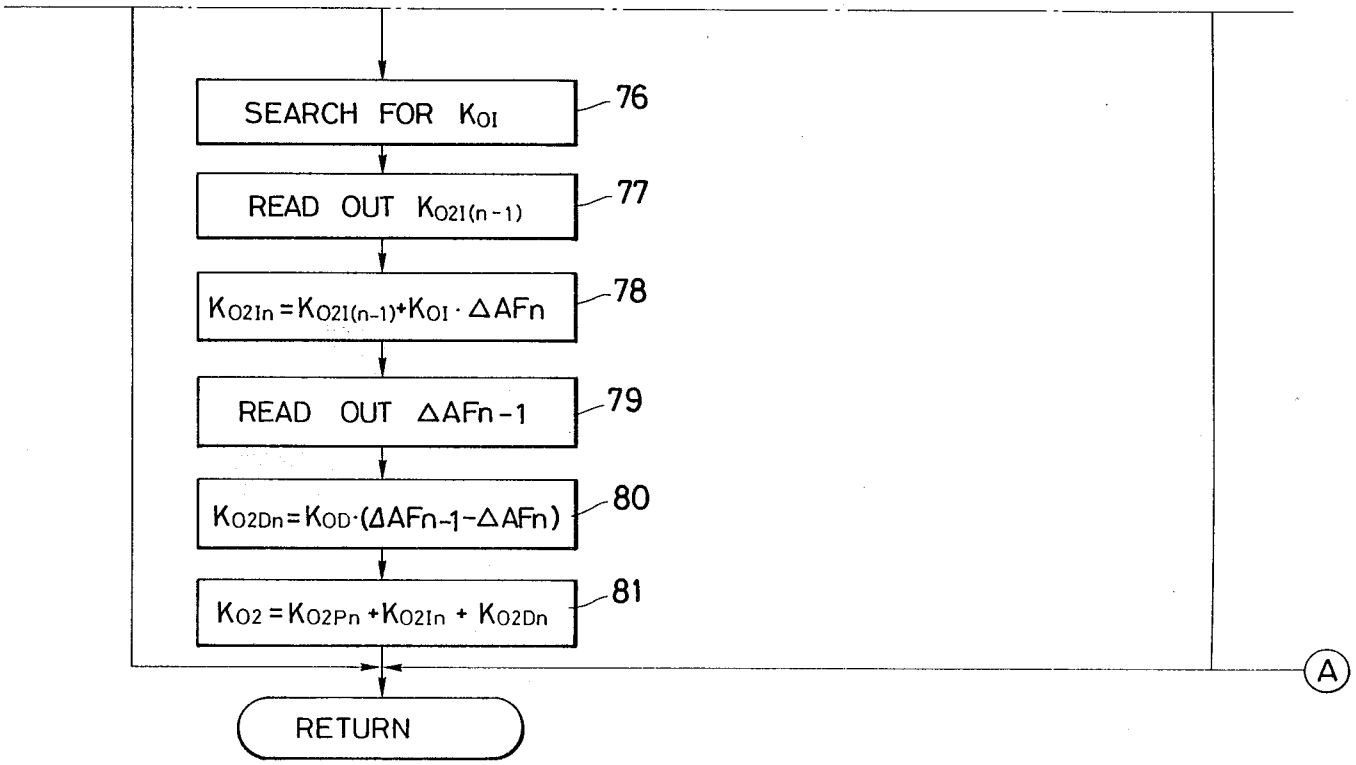
Figure 6:
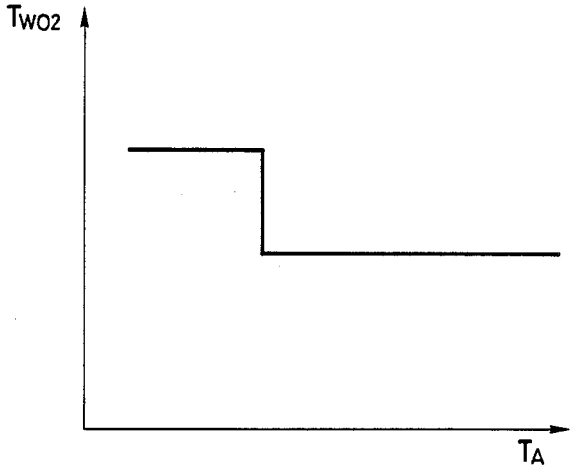
FIG. 6 is a graph showing the relationship between intake air temperature $T_A$ and temperature $T_{WO2}$.

In the operating sequence, as shown in FIGS. 4a and 4b, CPU 47 first judges whether or not activation of the oxygen concentration sensor has been completed (step 61). This decision can be based for example upon whether or not a predetermined time duration has elapsed since the supply of a heater current to the heater element 20 was initiated, or the decision can be based on the cooling water temperature $T_W$. If activation of the oxygen concentration sensor has been completed then, the intake air temperature $T_A$ is read in and temperature $T_{WO2}$ is set in accordance with this intake air temperature $T_A$ (step 62). A characteristic expressing the relationship between intake air temperature $T_A$ and temperature $T_{WO2}$, having the form shown graphically in FIG. 6, is stored beforehand in ROM 48 as a $T_{WO2}$ data map, and the temperature $T_{WO2}$ corresponding to the intake temperature $T_A$ that has been read in is obtained by searching this $T_{WO2}$ data map. Thus, after setting the temperature $T_{WO2}$, a target air/fuel ratio $AF_{TAR}$ is set in accordance with various types of data (step 63). The pump current $I_P$ is then read in (step 64), and the detected air/fuel ratio $AF_{ACT}$ that is expressed by this pump current is obtained from an AF data map (which was stored beforehand in ROM 48) (step 65). The target air/fuel ratio $AF_{TAR}$ can, for example, be obtained by searching a data map (stored beforehand in ROM 48) that is separate from the AF data map, with the search being executed in accordance with the engine speed $N_e$ and the absolute pressure $P_{BA}$ within the intake pipe. A decision is made as to whether or not the target air/fuel ratio $AF_{TAR}$ thus established is within the range 14.2 to 15.2 (step 66). If $AF_{TAR}<14.2$, or $>15.2$, then the cooling water temperature $T_W$ is read in. In order to execute feedback control of the target air/fuel ratio $AF_{TAR}$, since the target air/fuel ratio value which has been established is excessively different from the stoichiometric air/fuel ratio. A decision is made as to whether or not the cooling water temperature $T_W$ is greater than temperature $T_{WO2}$ (step 67). If $T_W \leqq T_{WO2}$, then a tolerance value $DAF_1$ is subtracted from the detected air/fuel ratio $AF_{ACT}$, and a decision is made as to whether or not the value resulting from this subtraction is greater than the target air/fuel ratio $AF_{TAR}$ (step 68). If $AF_{ACT}-DAF_1>AF_{TAR}$, then this indicates that the detected air/fuel ratio $AF_{ACT}$ is more lean than the target air/fuel ratio $AF_{TAR}$, and so a quantity $AF_{ACT}-(AF_{TAR}+DAF_1)$ is stored in RAM 49, as the current value of the deviation $\Delta AF_n$ (step 69). If $AF_{ACT}-DAF_1 \leqq AF_{TAR}$, then a decision is made as to whether or not the value resulting from adding the tolerance value $DAF_1$ to the detected air/fuel ratio $AF_{ACT}$ is smaller than the target air/fuel ratio $AF_{TAR}$ (step 70). If $AF_{ACT}+DAF_1<AF_{TAR}$, then this indicates that the detected air/fuel ratio $AF_{ACT}$ is more rich than the target air/fuel ratio $AF_{TAR}$, and so the value $AF_{ACT}-(AF_{TAR}-DAF_1)$ is stored in RAM 49 as the current value of deviation $\Delta AF_n$ (step 71). If $AF_{ACT}+DAF_1 \geqq AF_{TAR}$, then this indicates that the detected air/fuel ratio $AF_{ACT}$ is within the tolerance value $DAF_1$ with respect to the target air/fuel ratio $AF_{TAR}$, and so zero is stored as the current value of deviation $\Delta AF_n$ in RAM 49 (step 72).

If $T_W>T_{WO2}$, then a learning control subroutine is executed (step 73). After execution of the learning control subroutine, step 68 and the following steps are executed to compute the deviation $\Delta F_n$.

When deviation $\Delta AF_n$ has been computed in step 69, 71 or 72, a proportional control coefficient $K_{OP}$ is obtained by searching a $K_{OP}$ data map (stored beforehand in ROM 48) in accordance with the engine speed $N_e$ and the deviation $\Delta AF$ ($=AF_{ACT}-AF_{TAR}$) (step 74). The deviation $\Delta AF_n$ is then multiplied by the proportional control coefficient $K_{OP}$ to thereby compute the current value of a proportional component $K_{O2Pn}$ (step 75). In addition, an integral control coefficient $K_{OI}$ is obtained by searching a $K_{OI}$ data map (stored beforehand in ROM 48) in accordance with the engine speed $N_e$ (step 76). The previous value of an integral component $K_{O2I(n-1)}$ is then read out from RAM 49 (step 77), and the deviation $\Delta AF_n$ is multiplied by the integral control coefficient $K_{OI}$ and a previous value of the integral component $K_{O2I(n-1)}$ (i.e. the value of this integral component which was obtained in a previous execution of this subroutine) is added to the result of the multiplication, to thereby compute the current value of the integral component $K_{O2In}$ (step 78). The preceding value of deviation $\Delta AF_{n-1}$ (i.e. the value of deviation obtained in a previous execution of this subroutine) is again read out from RAM 49 (step 79). The current deviation value $\Delta AF_n$ is then subtracted from a previous deviation value $\Delta AF_{n-1}$, and the result is multiplied by a differential control coefficient $K_{OD}$, to thereby compute a current value of differential component $K_{O2Dn}$ (step 80). The values which have thus been computed for the proportional component $K_{O2Pn}$, the integral component $K_{O2In}$ and the differential component $K_{O2Dn}$ are then added together, to thereby compute the air/fuel ratio feedback compensation coefficient $K_{O2}$ (step 81).

If for example $AF_{ACT}=11$, $AF_{TAR}=9$ and $DAF_1=1$, then the air/fuel ratio is judged to be lean, and the proportional component $K_{O2Pn}$, the integral component $K_{O2In}$ and the differential component $K_{O2Dn}$ are respectively computed by using a value $\Delta AF_n=1$. For the case in which $AF_{ACT}=7$, $AF_{TAR}=9$ and $DAF_1=1$, the air/fuel ratio is judged to be rich, and the proportional component $K_{O2Pn}$, the integral component $K_{O2In}$ and the differential component $K_{O2Dn}$ are respectively computed by using a value $\Delta AF_n=-1$. If $AF_{ACT}=11$, $AF_{TAR}=10$ and $DAF_1=1$, then the detected $AF_{ACT}$ is judged to be within the tolerance value $DAF_1$ with respect to the target air/fuel ratio $AF_{TAR}$, and therefore $\Delta AF_n$ is made equal to zero. If the latter condition continues, then both $K_{O2Pn}$ and $K_{O2Dn}$ are set to zero, and the feedback control is executed in accordance with the integral component $K_{O2In}$ alone. The proportional control coefficient $K_{OP}$ is established in accordance with the engine speed $N_e$ and the deviation $\Delta AF$, so that $K_{OP}$ is based upon considerations of the deviation of the detected air/fuel ratio from the target air/fuel ratio and the speed of flow of the intake mixture. As a result, improved speed of the control response is attained with respect to changes in the air/fuel ratio.

If on the other hand, for example, it is judged in step 66 that $14.2 \leqq AF_{TAR} \leqq 15.2$, then the feedback control is applied by executing the $\lambda=1$PID control subroutine, for a value of target air/fuel ratio which is equal to the stoichiometric air/fuel ratio (step 82).

Figures 5, 5A:
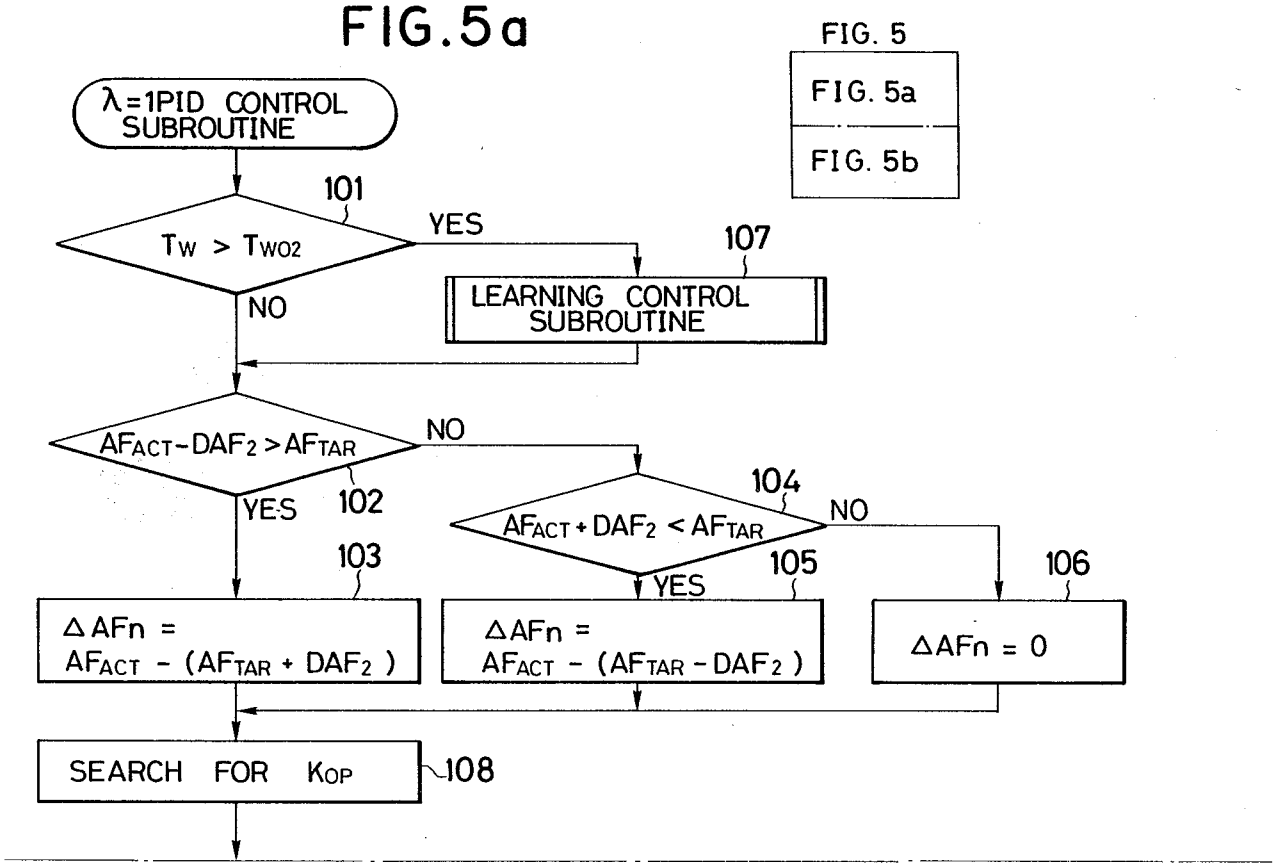
Figure 5B:
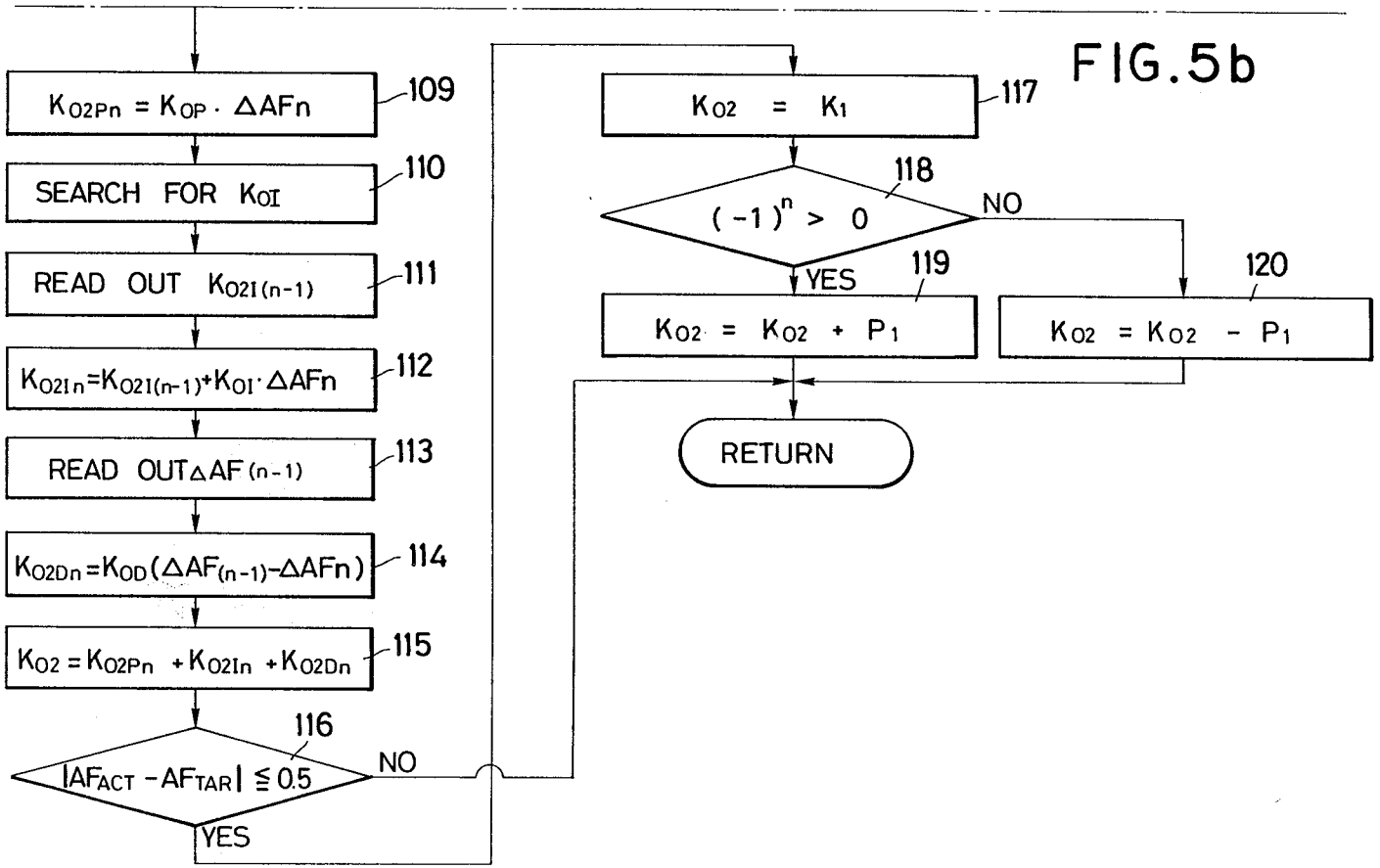

In the $\lambda=1$PID control subroutine, as shown in FIGS. 5a and 5b the cooling water temperature $T_W$ is first read in, and a decision is made as to whether or not $T_W$ is higher than temperature $T_{WO2}$ (step 101). If $T_W \leqq T_{WO2}$, then the tolerance value $DAF_2$ is subtracted from the detected air/fuel ratio $AF_{ACT}$, and a decision is made as to whether or not the value which is thus obtained is greater than the target air/fuel ratio $AF_{TAR}$ (step 102). If $AF_{ACT}-DAF_2>AF_{TAR}$, then this indicates that the detected air/fuel ratio $AF_{ACT}$ is more lean than the target air/fuel ratio $AF_{TAR}$, and therefore the value $AF_{ACT}-(AF_{TAR}+DAF_2)$ is stored in RAM 49 as the current value of deviation $\Delta AF_n$ (step 103). If $AF_{ACT}-DAF_2<AF_{TAR}$, then the detected air/fuel ratio $AF_{ACT}$ is added to the tolerance value $DAF_2$, and a decision is made as to whether or not the result is smaller than the target air/fuel ratio $AF_{TAR}$ (step 104). If $AF_{ACT}+DAF_2 \geqq AF_{TAR}$, then this indicates that the detected air/fuel ratio $AF_{ACT}$ is more rich than the target air/fuel ratio $AF_{TAR}$, and therefore the value $AF_{ACT}-(AF_{TAR}-DAF_2)$ is stored in RAM 49 as the current value of deviation $\Delta AF_n$ (step 105). If $AF_{ACT}+DAF_2>AF_{TAR}$, then this indicates that the detected air/fuel ratio $AF_{ACT}$ is within the tolerance value $DAF_2$ with respect to the target air/fuel ratio $AF_{TAR}$, and so the current value of deviation $\Delta AF_n$ is set to zero, and stored in RAM 49 (step 106).

If $T_W>T_{WO2}$, then the learning control subroutine is executed (step 107). After execution of the learning control subroutine, step 102 and the following steps are executed to compute the deviation $\Delta AF_n$.

After computing the deviation $\Delta AF_n$ in step 103, 105 or 106, the proportional control coefficient $K_{OP}$ is obtained by searching a $K_{OP}$ data map (stored beforehand in ROM 48). This search is performed in accordance with the engine speed $N_e$ and the deviation $\Delta AF$ ($=AF_{ACT}-AF_{TAR}$) (step 108). The value of a proportional control coefficient $K_{OP}$ thus obtained is multiplied by the deviation $\Delta AF_n$, to compute the current value of the proportional component $K_{O2Pn}$ (step 109). The integral control coefficient $K_{OI}$ is then obtained by searching a $K_{OI}$ data map (stored beforehand in ROM 48), in accordance with the engine speed $N_e$ (step 110), and a previous value of the integral component $K_{O2I(n-1)}$ (obtained in a previous execution of this subroutine) is then read out from RAM 49 (step 111). The integral control coefficient $K_{OI}$ is multiplied by the deviation $\Delta AF_n$, and the integral component $K_{O2I(n-1)}$ is added to the result, to thereby compute the current value of the integral component $K_{O2In}$ (step 112). The preceding value of deviation $\Delta AF_{n-1}$ is again read out from RAM 49 (step 113), and the current value of deviation $\Delta AF_n$ is then subtracted from $\Delta AF_{n-1}$ and the result of this subtraction is multiplied by a predetermined value of the differential control coefficient $K_{OD}$, to thereby compute the current value of the differential component $K_{O2Dn}$ (step 114). The values of the proportional component $K_{opn}$, the integral component $K_{O2In}$ and the differential component $K_{O2Dn}$ are then added together, to thereby compute the air/fuel ratio feedback compensation coefficient $K_{O2}$ (step 115).

After computing the air/fuel ratio feedback compensation coefficient $K_{O2}$ target air/fuel ratio $AF_{TAR}$ is subtracted from the detected air/fuel ratio $AF_{ACT}$, and a decision is made as to whether or not the absolute value of the result is equal to or lower than 0.5 (step 116). If $|AF_{ACT}-AF_{TAR}| \leqq 0.5$, then the compensation coefficient $K_{O2}$ is made equal to a predetermined value $K_1$ (step 117), and a decision is made as to whether or not $(-1)^n$ is greater than zero (step 118). If $(-1)^n>0$, then a predetermined value $P_1$ is added to the compensation coefficient $K_{O2}$, and the result becomes the compensation coefficient $K_{O2}$ (step 119). If $(-1)^n<0$, then a predetermined value $P_1$ is subtracted from the compensation coefficient $K_{O2}$, and the resultant value becomes the compensation coefficient $K_{02}$ (step 120). If $|AF_{ACT}-AE_{TAR}|>0.5$, then the value of the compensation coefficient $K_{O2}$ which was computed in step 115 is held unchanged. The predetermined value $K_1$ can be the value of the compensation coefficient $K_{O2}$ which is necesssary in order to control the air/fuel ratio, for example, to a vaue of 14.7.

Thus, if the condition $|AF_{ACT}-AF_{TAR}| \leqq 0.5$ is continued while the target air/fuel ratio $AF_{TAR}$ is close to the stoichiometric air/fuel ratio, then the value of the air/fuel ratio feedback compensation coefficient $K_{O2}$ will be alternately set to $K_{O2}+P_1$ and $K_{O2}-P_1$ as successive TDC signal pulses are produced. The fuel injection time interval $T_{OUT}$ is computed by using the value of the compensation coefficient $K_{O2}$ that is obtained as described above, from equation (1) given hereinabove, and fuel injection into a cylinder of engine 2 is performed by injector 36 for the precise duration of this fuel injection interval $T_{OUT}$. In this way, the air/fuel ratio of the mixture that is supplied to the engine will oscillate slightly, between the rich and the lean regions, about a central value of approximately 14.7. Perturbations are thereby induced within the engine cylinders, to thereby augment the effectiveness of pollutant reduction by the catalytic converter.

In step 62, the temperature $T_{WO2}$ is set in order to judge the cooling water temperature in relation to the intake air temperature $T_A$. The reason for this is that as the intake air temperature is lowered, the amount of fuel which will adhere to the interior surface of the intake pipe will be greater. Fuel increment compensation is applied by means of the compensation coefficient $K_{TW}$.

However the compensation coefficient $K_{O2}$ is used in computing the learning control compensation coefficient $K_{REF}$ by the learning control subroutine, and since the amount of fuel which adheres to the interior of the intake pipe will vary depending upon engine operating conditions, the accuracy of controlling the air/fuel ratio of the mixture supplied to the engine in accordance with the oxygen concentration sensor output will be decreased. In addition, the accuracy of the compensation coefficient $K_{O2}$ will be reduced. Thus, when $T_W > T_{WO2}$, a computed value of $K_{O2}$ is used to compute and update or renew the learning control compensation coefficient $K_{REF}$.

Figure 7A:
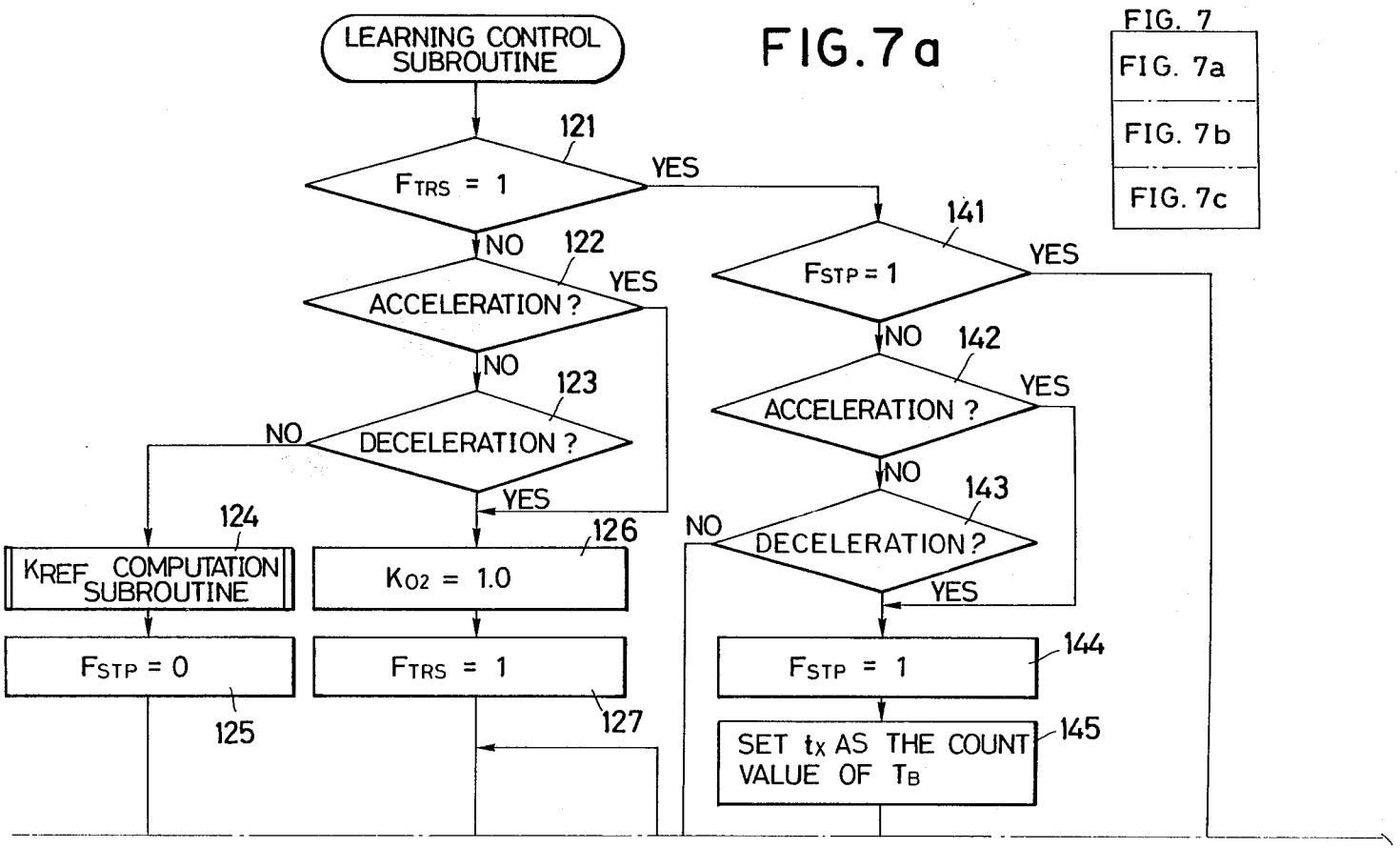
Figure 7B:
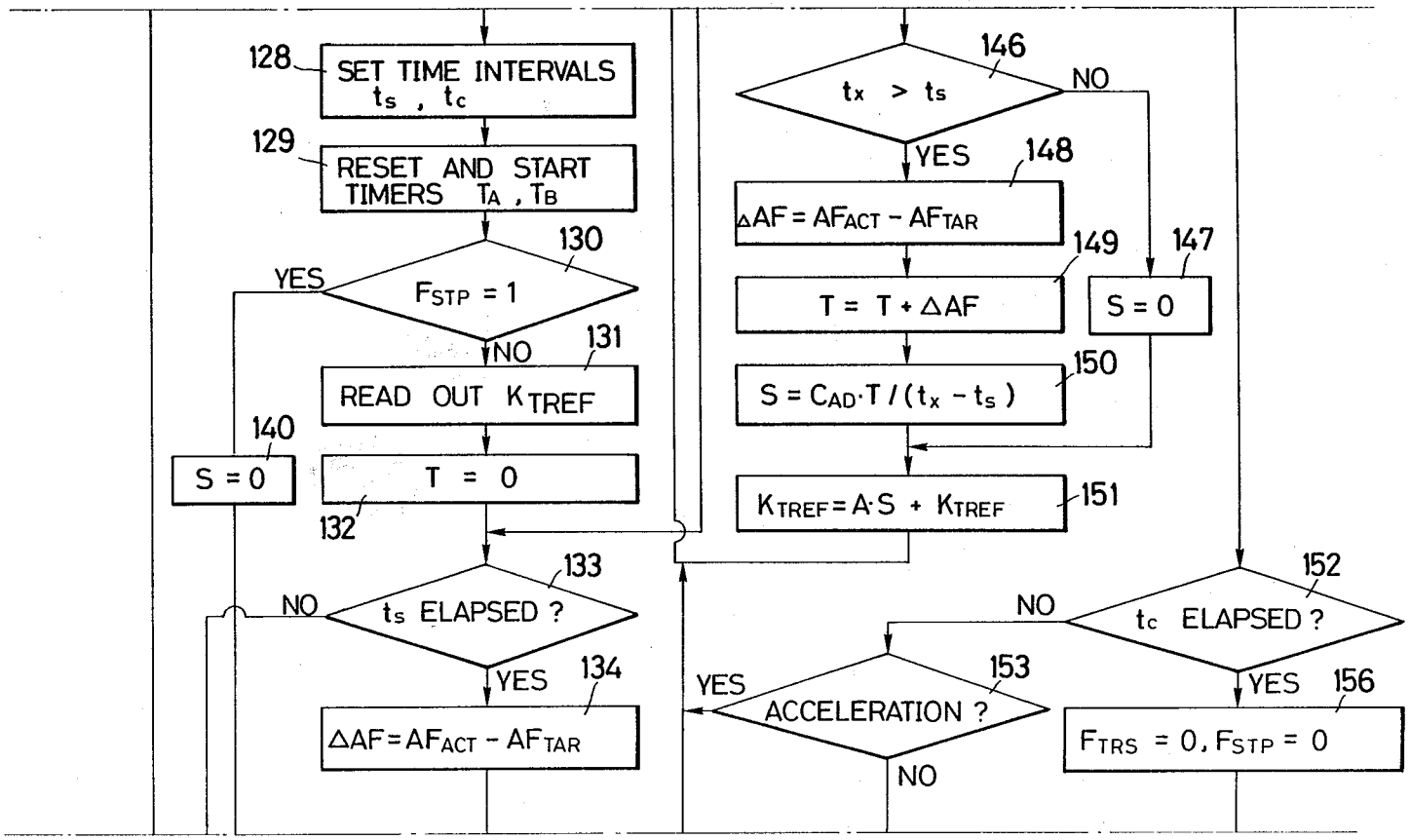
Figure 7C:
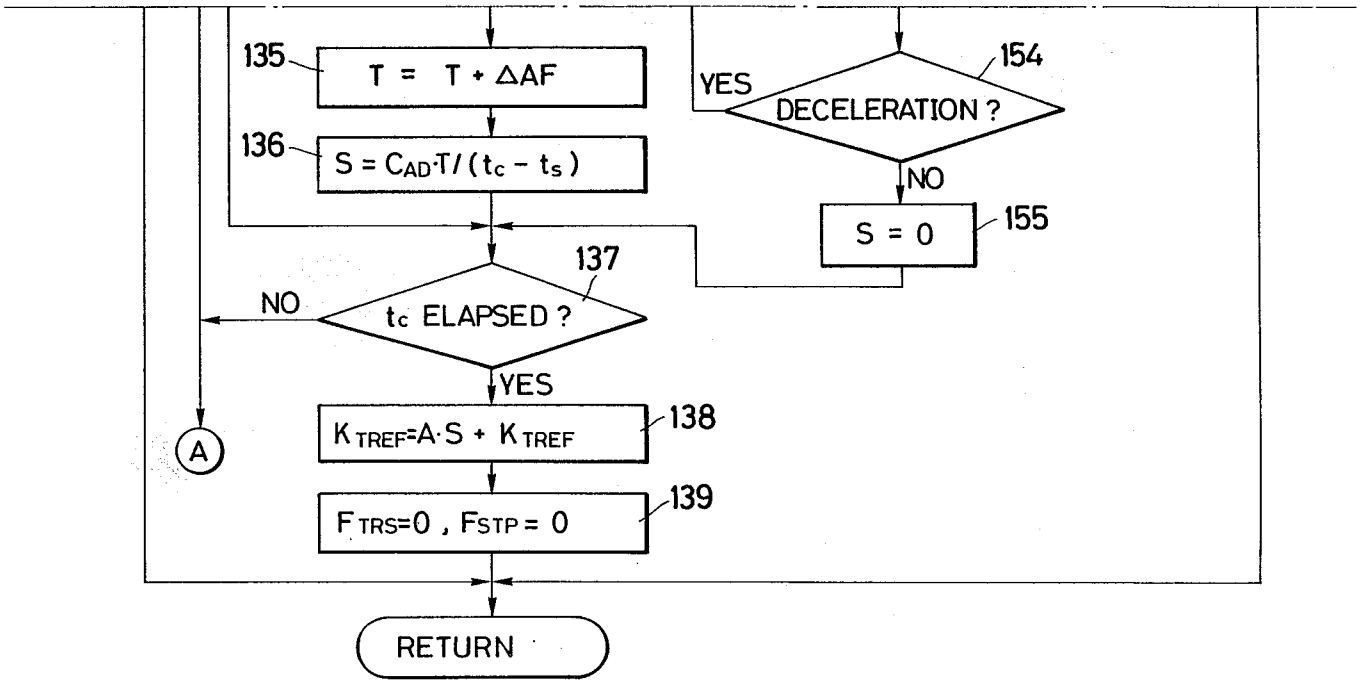

A learning control subroutine according to the present invention will now be described, referring to the flow chart of FIGS. 7a and 7b. Firstly, the CPU 47 judges whether or not a transitional operation flag $F_{TRS}$ is set to the 1 state (step 121). If $F_{TRS}=0$, then this indicates that a previous execution of the learning control subroutine was carried out under a condition of regular engine operation (i.e. without acceleration or deceleration) and hence a decision is made as to whether or not the engine is currently in an acceleration condition (step 122). If it is not in an acceleration condition, then a decision is made as to whether or not the engine is in a deceleration condition (step 123). The decision as to whether the engine is undergoing acceleration can be made for example by detecting and reading in the value of the degree of the throttle valve opening $\theta_{th}$ each time this subroutine is executed, and deciding whether the amount of change $\Delta\theta_{th}$ between the value of the degree of throttle valve opening $\theta_{thn}$ that is detected at this time and the value $\theta$ which was detected during a previous execution of the subroutine, i.e. the amount of change ($\theta_{thn}$ and $\theta_{th(n-1)}$), is greater than a predetermined value $G^+$. Conversely, the decision concerning the deceleration operation can be made by detecting whether the variation amount $\Delta\theta_{th}$ is smaller than a predetermined value $G^-$. If it is judged that the engine is currently operating in neither an acceleration nor a deceleration condition, then the $K_{REF}$ computation subroutine is executed, to compute and update the learning control compensation coefficient $K_{REF}$, for the current engine operating region. This region is determined by the engine speed $N_e$ and the absolute pressure $P_{BA}$ within the intake pipe (step 124). Flag $F_{STP}$ is then reset to zero (step 125).

Figure 8:
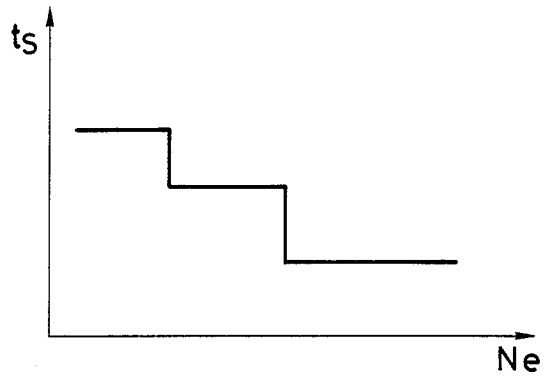
FIG. 8 is a graph showing the relationship between engine speed $N_e$ and acceleration/deceleration A/F delay time $t_s$.
Figure 9:
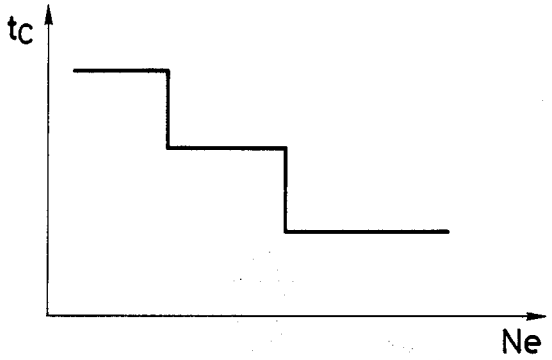
FIG. 9 is a graph showing the relationship between engine speed $N_e$ and acceleration/deceleration A/F continuation time $t_c$.
Figure 10:
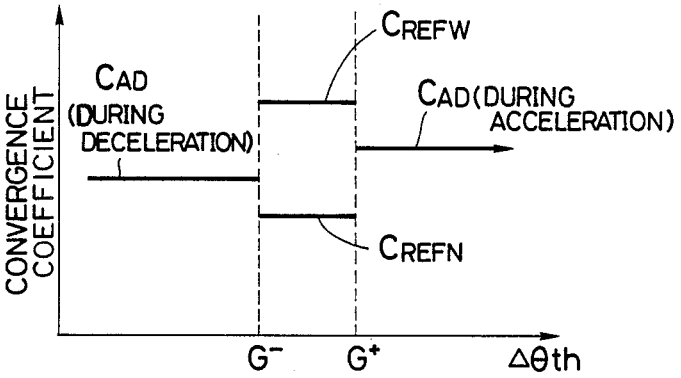
FIG. 10 is a diagram graphically illustrating relationships between change in degree of throttle valve opening $\Delta\theta_{th}$ and convergence coefficients $C_{AD}$, $C_{REFW}$ and $C_{REFN}$.

If on the other hand the engine is judged to be in an acceleration or a deceleration condition, then the air/fuel ratio feedback compensation coefficient $K_{O2}$ is made equal to 1, in order to halt the air/fuel ratio feedback control based on the oxygen concentration within the exhaust gas (step 126). The transitional operation flag $F_{TRS}$ is then set to 1 (step 127), and an acceleration/deceleration A/F delay time $t_s$ and an acceleration/deceleration A/F continuation time $t_c$ are respectively set (step 128). The acceleration/deceleration A/F delay time $t_s$ is the time which is required from the point at which fuel is supplied to the intake system (during acceleration or deceleration) until the products of that fuel supply are output to the exhaust system. A $t_s$ data map is stored beforehand in ROM 48, having the form shown graphically in FIG. 8, which represents the relationship between engine speed $N_e$ and corresponding values of the acceleration/deceleration A/F delay time $t_s$. A value of delay time $t_s$ is obtained by searching this $t_s$ data map in accordance with the current value of engine speed $N_e$. The acceleration/deceleration A/F continuation time $t_c$ is the time during which the supply of fuel is increased or decreased during an interval of acceleration or deceleration respectively. As for the acceleration/deceleration A/F delay time $t_s$, the relationship between the engine speed $N_e$ and corresponding values of acceleration/deceleration A/F continuation time $t_c$ is stored beforehand in a $t_c$ data map in ROM 48, this relationship having the form shown graphically in FIG. 9. A value of continuation time $t_c$ is obtained by searching this $t_c$ data map in accordance with the current value of engine speed $N_e$. After setting the values of acceleration/deceleration A/F delay time $t_s$ and acceleration/deceleration A/F continuation time $t_c$ in this way, timer $T_A$ is reset to zero and the operation of that timer is restarted. Timer $T_B$ is also reset to zero, and the operation is restarted (step 129), and a decision is made as to whether or not a transition status learning stop flag $F_{STP}$ is set to 1 (step 130). If $F_{STP}=0$, then a transition status learning control compensation coefficient $K_{TREF}$ that is determined in accordance with the current engine operating region as represented by the change $\Delta\theta_{th}$ in the degree of the throttle valve opening $\theta_{th}$ and the engine speed $N_e$, is read in. This value of the transition-status learning control compensation coefficient $K_{TREF}$ is obtained from a memory location (g,h) of the $K_{TREF}$ data map which is stored in RAM 49 (step 131). The deviation total value T is then made equal to zero (step 132), and a decision is then made on the basis of the measured value of timer $T_A$ as to whether or not the time interval $t_s$ has elapsed since an acceleration or a deceleration operation was detected (step 133). If time $t_s$ has elapsed, then the difference $\Delta AF$ between the target air/fuel ratio $AF_{TAR}$ and the detected air/fuel ratio $AF_{ACT}$ is computed (step 134). The deviation total value T is then added to the deviation $\Delta AF$, and the result of this addition is stored as the new deviation total value T (step 135). The deviation total value T is then divided by the time interval between the point at which $t_s$ has elapsed and the point at which $t_c$ has elapsed, and the result is multiplied by the convergence coefficient $C_{AD}$, to thereby compute the integral value S (step 136). The convergence coefficient $C_{AD}$ is set to respectively different values in accordance with whether the engine is in acceleration or a deceleration operation, as shown graphically in FIG. 10, and a decision is made as to whether or not the time interval $t_c$ has elapsed since acceleration or deceleration was detected. This decision is made based on the measured value of timer $T_B$ (step 137). If the intervals $t_s$ and $t_c$ have not elapsed, then then execution returns to the $K_{O2}$ computation subroutine, thereby completing the $K_{O2}$ computation processing. If however the interval $t_c$ has elapsed, then value S is computed by using the deviation total value T, i.e. the time extending from the point at which interval $t_s$ elapsed until the point at which $t_c$. A new value of the compensation coefficient $K_{TREF}$ is then computed by multiplying the integral value S by a constant A, and adding the result to the value of the compensation coefficient $K_{TREF}$ which was read out in step 131. The newly computed value of $K_{TREF}$ is then written into the $K_{TREF}$ data map, at memory location (g,h) (step 138). The transitional operation flag $F_{TRS}$ and the transition status learning stop flag $F_{STP}$ are then both reset to zero (step 139). If $F_{STP}$ is found to be one in step 130, then since this indicates that the transition status learning operation is halted during a transitional running condition (i.e. acceleration or deceleration), the integral value S is made equal to zero (step 140), and execution immediately moves to step 137. It should be noted that timers $T_A$ and $T_B$ can each be implemented as registers within the CPU 47, with time intervals being measured by counting clock pulses. Furthermore, with respect to the memory location (g,h), g takes respective values 1, 2, . . . , v in accordance with the degree of the engine speed $N_e$, while the quantity h takes respective values 1, 2, . . . , w in accordance with the amplitude of the variation amount $\Delta\theta_{th}$.

If on the other hand, $F_{TRS}$ is found to be equal to one in step 121, then since this indicates that the engine was found to be operating in a transitional running condition (i.e. acceleration or deceleration) during a previous execution of the learning control subroutine, a decision is made as to whether or not the transition status learning stop flag $F_{STP}$ is equal to one. If $F_{STP}=0$, then this indicates that the current operation is not in the transition status learning stop condition, and a decision is made as to whether or not the engine is operating in acceleration (step 142). If acceleration is not detected at step 142, then a decision is made as to whether or not the engine is operating in deceleration (step 143). If, after engine acceleration or deceleration has been previously detected in step 122 or 123, it is found during step 142 that the acceleration has ceased (or found during step step 143 that the deceleration has ceased) during the transition status learning control operation, then execution immediately moves to step 133. If on the other hand after engine acceleration or deceleration has been previously detected in step 122 or 123, and acceleration is again detected in step 142 or deceleration is again detected in step 143, during the transition status learning control operation, then it will not be possible to accurately determine the compensation coefficient $K_{TREF}$ from the deviation $\Delta AF$, up to the end of interval $t_c$. In addition, there will be a considerable variation in the air/fuel ratio. For this reason, the transition status learning stop flag $F_{STP}$ is set to the one state (step 144), and the time interval $t_x$ which has elapsed since acceleration or deceleration was detected is read in as the measured value of timer $T_B$ (step 145), and a decision is made as to whether or not the time interval $t_x$ is greater than $t_s$ (step 146). If $t_x \leqq t_s$, then the integral value S is made zero, (step 147), while if $t_x > t_s$, then the deviation $\Delta AF$ of the detected air/fuel ratio $AF_{ACT}$ from the target air/fuel ratio $AF_{TAR}$ is computed (step 148), and this deviation $\Delta AF$ is added to the deviation total value T to thereby compute a new value for T, which is then stored (step 149). The deviation total value T is then divided by the time interval between the point at which $t_s$ has elapsed and the point at which $t_x$ has elapsed, and the result is multiplied by the convergence coefficient $C_{AD}$, to thereby compute the integral value S (step 150). A new value of the compensation coefficient $K_{TREF}$ is then computed by multiplying the integral value S by a constant A, and adding the result to the value of the compensation coefficient $K_{TREF}$ which was read out in step 131. The newly computed value of $K_{TREF}$ is then written into the $K_{TREF}$ data map, at memory location (g,h) (step 151). After computing and updating the compensation coefficient $K_{TREF}$ in this way, step 128 and the subsequent steps thereafter are executed, with timer $T_B$ being reset in order to determine when the acceleration/deceleration A/F continuation time $t_c$ elapses. In this way, if acceleration or deceleration is again detected, before the point at which the acceleration/deceleration A/F delay time $t_s$ has elapsed, then updating of the compensation coefficient $K_{TREF}$ is interrupted (i.e. learning control is halted) until a newly set value of the acceleration/deceleration A/F continuation time $t_c$ has elapsed. Furthermore, if either acceleration or deceleration is again detected during the time interval extending from the point at which the acceleration/deceleration A/F delay time $t_s$ elapses until the point at which the acceleration/deceleration A/F continuation time $t_c$ elapses, then the compensation coefficient $K_{TREF}$ is computed and updated by using the value of deviation $\Delta AF$ which was obtained up to the point at which acceleration or deceleration was again detected, and the learning control is again halted until the newly set value of the acceleration/deceleration A/F continuation time $t_c$ has elapsed.

If it is found that $F_{STP}=1$ in step 141, then a decision is made as to whether or not the interval $t_c$, extending from the point of detection of deceleration or acceleration, has elapsed. This decision is based on the time measured by timer $T_B$ (step 152). If the interval $t_c$ has not elapsed, then a decision is made as to whether or not the engine is currently in an acceleration condition (step 153). If it is found not to be accelerating, then a decision is made as to whether or not the engine is decelerating (step 154). If acceleration is not detected during the transition status learning stop condition, or if deceleration is not detected while that condition is being maintained, then the integral value S is made equal to zero (step 155), and execution moves to step 137. Furthermore, if acceleration is detected during the transition status learning stop condition, or if deceleration is detected during that condition, then the steps extending from 128 are executed. Measurement of the lapse of the acceleration/deceleration A/F continuation time $t_c$ by timer $T_B$ is thereby commenced. Thereafter, the learning control is halted until the acceleration/deceleration A/F continuation time $t_c$ which has thus been newly set has elapsed. When interval $t_c$, extending from the point at which acceleration or deceleration was again detected, has elapsed, the transitional operation flag $F_{TRS}$ and the transition status learning stop flag $F_{STP}$ are respectively reset to zero, in order to enable the transitional learning control to be implemented during the next period in which this routine is executed (step 156). Execution then returns to the main routine.

Figure 11:
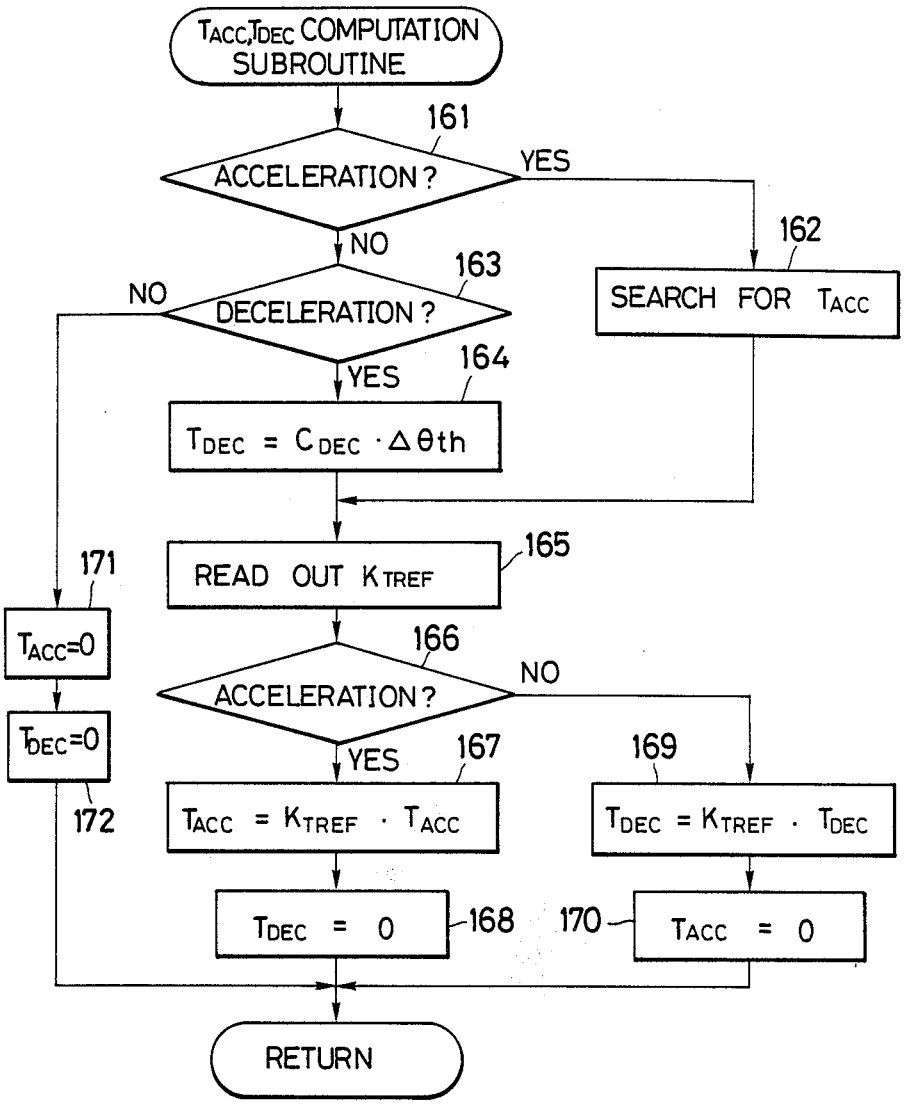

FIG. 11 is a flow chart of the $T_{ACC}$, $T_{DEC}$ computation subroutine. CPU 47 first judges whether or not engine acceleration is in progress (step 161). If acceleration is detected, then the acceleration increment value $T_{ACC}$ corresponding to the amount of change $\Delta\theta_{th}$ of the degree of the throttle valve opening $\theta_{th}$ is obtained by searching a $T_{ACC}$ data map (stored beforehand in ROM 48) (step 162). If acceleration is not detected, then a decision is made as to whether or not deceleration is in progress (step 163). If deceleration is detected, then the deceleration decrement value $T_{DEC}$ is computed, by multiplying the change $\Delta\theta_{th}$ of the degree of the throttle value opening $\theta_{th}$ by a constant $C_{DEC}$ (step 164). When the acceleration increment value $T_{ACC}$ or the deceleration decrement value $T_{DEC}$ has been set in this way, a transition status learning control compensation coefficient $K_{TREF}$, is determined in accordance with the current engine operating region as represented by the change $\Delta\theta_{th}$ in the degree of the throttle valve opening $\theta_{th}$ and the engine speed $N_e$, is read in. This value of transition status learning control compensation coefficient $K_{TREF}$ is obtained from a memory location (g, h) of the $K_{TREF}$ data map which is stored in RAM 49 (step 165). The value of the compensation coefficient $K_{TREF}$ which is thus read out is the updated value which was obtained by executing the learning control subroutine as described hereinabove. A decision is again made as to whether or not engine acceleration is in progress (step 166). If acceleration is detected, then the acceleration increment value $T_{ACC}$ is multiplied by the compensation coefficient $K_{TREF}$, to thereby compute a new value of $T_{ACC}$ (step 167) and the deceleration decrement value $T_{DEC}$ is set to zero (step 168). If acceleration is not detected, but deceleration is detected, then the deceleration decrement value $T_{DEC}$ is multiplied by the compensation coefficient $K_{TREF}$ to thereby compute a new value for $T_{DEC}$ (step 169 and the acceleration increment value $T_{ACC}$ to set to zero, (step 170). If neither acceleration nor deceleration is detected, then the acceleration increment value $T_{ACC}$ and the deceleration decrement value $T_{DEC}$ are respectively set to zero (steps 171, 172).

Figure 12:
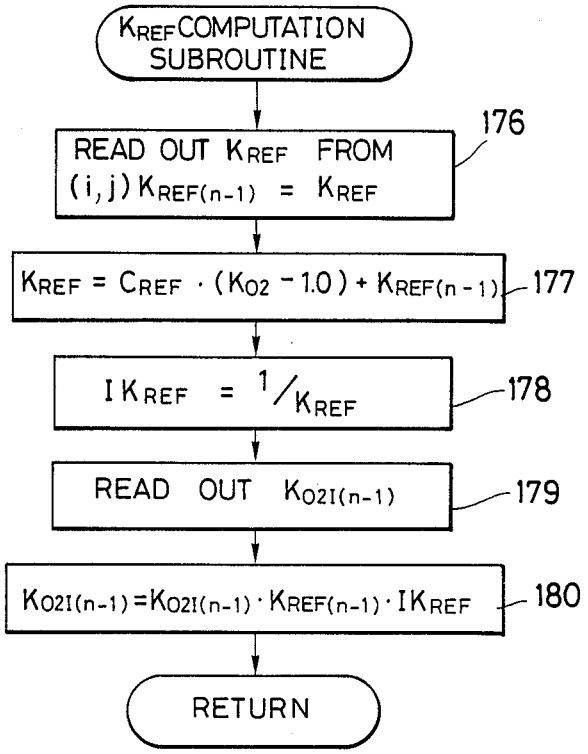

The $K_{REF}$ computation subroutine will now be described, referring to the flow chart of FIG. 12. As shown in FIG. 12, CPU 47 first reads out the compensation coefficient $K_{REF}$ corresponding to the current engine operating region, as determined by the engine speed $N_e$ and the absolute pressure $P_{BA}$ within the intake pipe, with $K_{REF}$ being obtained from memory location (i, j) of the $K_{REF}$ data map. This value of $K_{REF}$ is then designated as a previous value $K_{REF(n-1)}$ (step 176).

The memory locations (i, j), are determined as follows. i takes respective values 1, 2, . . . , x in accordance with the degree of engine speed $N_e$, while j takes respective values 1, 2, . . . , y in accordance with the value of the absolute pressure $P_{BA}$ within the intake pipe. The compensation coefficient $K_{REF}$ is computed by using the following equation, and the result is stored in memory location (i, j) of the $K_{REF}$ data map (step 177).

$$K_{REF}=C_{REF}\cdot(K_{O2}-1.0)+K_{REF(n-1)} \quad (2)$$

In the above, $C_{REF}$ is a convergence coefficient.

After having computed and stored an updated value for compensation coefficient $K_{REF}$ in the $K_{REF}$ data map at memory location (i, j), the inverse of that value of $K_{REF}$, designated as $IK_{REF}$, is computed (step 178). The integral component $K_{O2I(n-1)}$ from a previous execution of the routine is then read out from RAM 49 (step 179), then $K_{O2I(n-1)}$, the previously obtained value $K_{REF(n-1)}$, and the inverse value $IK_{REF}$ are multiplied together, and the result is stored in RAM 49 as integral component $K_{O2I(n-1)}$ (step 180). The value of $K_{O2I(n-1)}$ which is computed in the computation of step 180 is used in step 78 or step 112 to compute the value of the integral component $K_{O2In}$, to thereby enhance the rapidity of response to changes in the air/fuel ratio.

In this $K_{REF}$ computation subroutine, the compensation coefficient $K_{REF}$ is computed such as to make the compensation coefficient $K_{O2}$ become equal to 1.0, and the value of the compensation coefficient $K_{REF}$ thereby computed in accordance with the current operating region of the engine is utilized to execute the learning control operation.

Figure 13A:
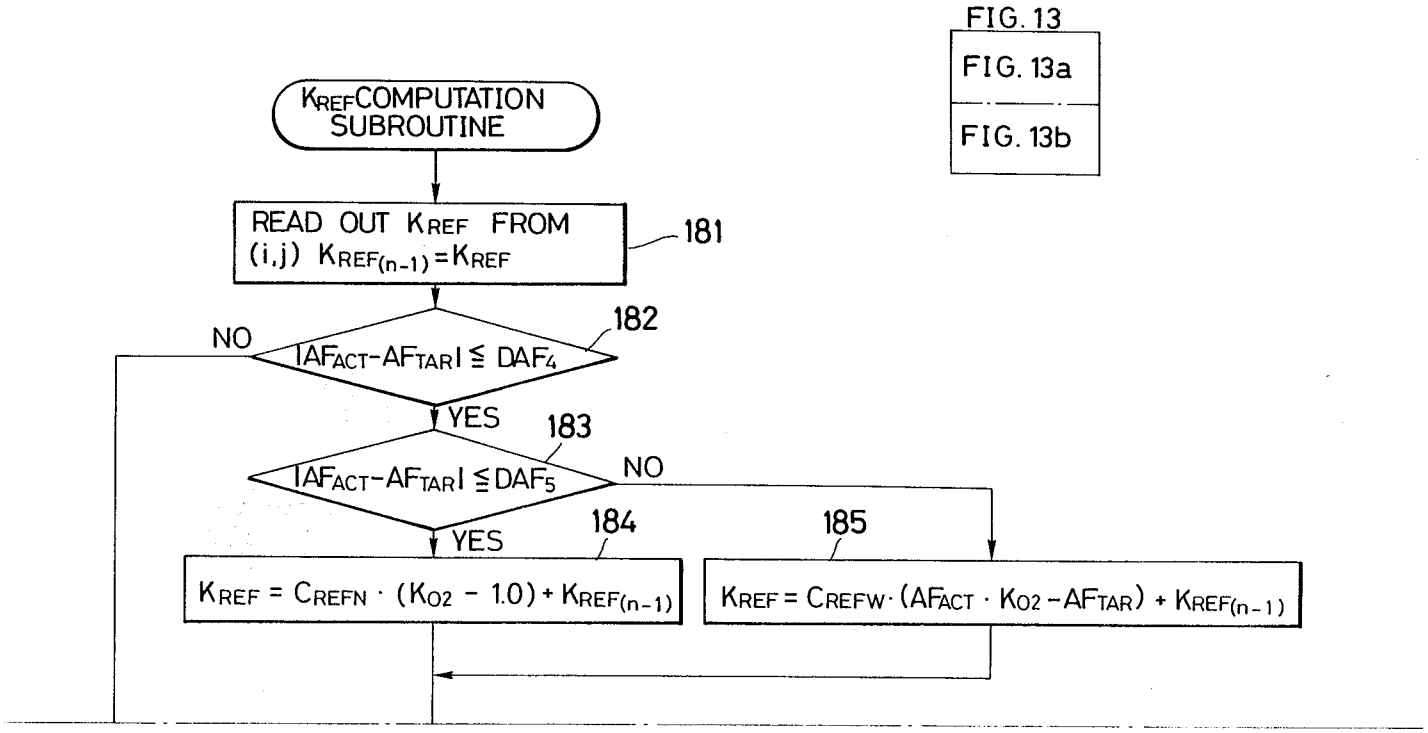
Figure 13B:
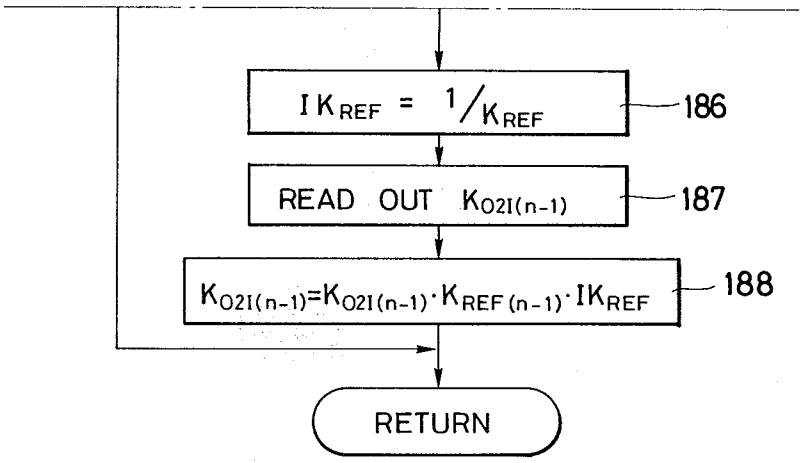

FIG. 13 is a flow chart of another example of a $K_{REF}$ computation subroutine. As shown in FIG. 13, CPU 47 first reads out the compensation coefficient $K_{REF}$ corresponding to the current engine operating region, as determined by the engine speed $N_e$ and the absolute pressure $P_{BA}$ within the intake pipe, with $K_{REF}$ being obtained from memory location (i, j) of the $K_{REF}$ data map. This value of $K_{REF}$ is then designated as a previous value $K_{REF(n-1)}$ (step 181). The target air/fuel ratio $AF_{TAR}$ is then subtracted from the detected air/fuel ratio $AF_{ACT}$, and a decision is made as to whether or not the absolute value of the result of this subtraction is less than a predetermined value $DAF_4$ (for example, 1) (step 182). If $|AF_{ACT}-AF_{TAR}|>DAF_4$, then execution of the $K_{REF}$ computation subroutine is halted, and execution returns to the main routine. If the $|AF_{ACT}-AF_{TAR}|\leqq DAF_4$, then a decision is made as to whether or not $|AF_{ACT}-AF_{TAR}|$ is lower than a predetermined value $DAF_5$ (where $DAF_4>DAF_5$). $DAF_5$ may for example be 0.5. (step 183). If $|AF_{ACT}-AF_{TAR}|\leqq DAF_5$, then the compensation coefficient $K_{REF}$ is computed by using equation (2) above, and is then stored in the $K_{REF}$ data map at memory location (i, j) (step 184).

If on the other hand $|AF_{ACT}-AF_{TAR}|>DAF_5$, then $K_{REF}$ is computed using equation (3) given below, and stored in the $K_{REF}$ data map at location (i, j) (step 185). PS $$K_{REF}=C_{REFW}\cdot(AF_{ACT}\cdot K_{O2}-AF_{TAR})+K_{REF(n-1)} \quad (3)$$

In the above, $C_{REFW}$ is a convergence coefficient, where $C_{REFW}>C_{REFN}$.

After having computed and stored an updated value for the compensation coefficient $K_{REF}$ in the $K_{REF}$ data map at memory location (i, j) in this way, the inverse of that value of $K_{REF}$, designated as $IK_{REF}$, is computed (step 186). The integral component $K_{O2I(n-1)}$ from a previous execution of the routine is then read out from RAM 49 (step 187), then this preceding value $K_{O2I(n-1)}$, a previous value $K_{REF(n-1)}$, and the inverse value $IK_{REF}$ are multiplied together, and the result is stored in RAM 49 as an integral component $K_{O2I(n-1)}$ (step 188). The value of $K_{O2I(n-1)}$ which is computed in the computation of step 188 is also used in step 78 or step 112 to compute the current value of integral component $K_{O2In}$, to thereby enhance the rapidity of response to changes in the air/fuel ratio.

With this $K_{REF}$ computation subroutine, if $|AF_{ACT}-AF_{TAR}|\leqq DAF_4$, then the compensation coefficient $K_{REF}$ is computed such as to make the compensation coefficient $K_{O2}$ become 1.0. Normally, the compensation coefficient $K_{REF}$ will be updated at that point, in accordance with the current operating region of the engine, and the learning control then executed. If $|AF_{ACT}-AF_{TAR}|>DAF_5$, at the time when the compensation coefficient $K_{REF}$ is computed, then the compensation coefficient $K_{REF}$ is made larger than the case when $|AF_{ACT}-AF_{TAR}|\leqq DAF_5$, to thereby increase the speed of compensation.

With a method of air/fuel ratio control according to the present invention, as described hereinabove, a basic value of a quantity used to control the supply of fuel to an engine, e.g. a fuel injection time interval is established based on the current engine operating condition, i.e. as determined by a plurality of parameters relating to engine load, and a sequence of operations is executed at periodic intervals. These operations include detecting the air/fuel ratio of the mixture supplied to the engine, based upon the oxygen concentration sensor output; setting a target air/fuel ratio; calculating the feedback compensation coefficient ($K_{O2}$) in accordance with the deviation ($\Delta AF_n$) of the detected air/fuel ratio from the target air/fuel ratio; calculating a learning control compensation coefficient ($K_{REF}$) separately per the respective engine operational regions (i, j) defined by at least one engine operating parameter; renewing the learning control coefficient separately per the respective engine operational regions (i, j); correcting the basic value by the feedback compensation coefficient and the learning control compensation coefficient so as to obtain an output value ($T_{OUT}$); and controlling the supply of fuel by the obtained output value, wherein the feedback compensation coefficient is corrected by the preceding and current values of the learning control compensation coefficient.

In this way, compensation of the basic value is always performed by using the most recent compensation value, and an output value (e.g. for the fuel injection time interval) is thereby obtained for attaining the target air/fuel ratio. In this way, a high speed of response is obtained with respect to changes in the air/fuel ratio, so that a more accurate air/fuel ratio control can be applied. Improved engine performance and more effective exhaust pollution elimination are thereby attained. Furthermore, when engine acceleration or deceleration is detected, a transition compensation value is set in accordance with the degree of acceleration or deceleration, and the basic value is compensated by this transition compensation value, to thereby determine the aforementioned output value. In addition, when acceleration or deceleration is detected, the transition compensation value is corrected by a second compensation value which is obtained by the learning control which is executed in accordance with a deviation of the detected air/fuel ratio (obtained from the output of the oxygen concentration sensor) and the target air/fuel ratio. In this way, delays in response to air/fuel ratio control are reduced, and improved control accuracy of air/fuel ratio is attained during acceleration or deceleration. This further assists in providing enhanced engine performance and effective elimination of exhaust gas pollutants.

What is claimed is:

1. A method of control of an air/fuel ratio of a mixture supplied to an internal combustion engine equipped with an oxygen concentration sensor disposed in an exhaust system for producing an output varying in proportion to an oxygen concentration in an exhaust gas of the engine, the method comprises setting a basic value ($T_i$) for control of the air/fuel ratio, in accordance with a plurality of engine operating parameters relating to engine load and periodically executing at predetermined intervals a sequence of operations comprises:

detecting said air/fuel ratio of said mixture based upon the oxygen concentration sensor output;

computing a current first compensation value ($K_{REF}$) for compensating an error of said basic value, utilized in the computation is a preceding first compensation value computed during a previous execution of said sequence of operations in which an operating region of said engine was substantially identical to an operating region during computation of said current first compensation value, where said operating region is determined in accordance with said plurality of engine operating parameters;

computing a deviation from a target air/fuel ratio of an air/fuel ratio detected by utilizing said output of said oxygen concentration sensor, and compensating said deviation by said current first compensation value and said preceding first compensation value to obtain a second compensation value ($K_{O2}$);

computing an output value ($T_{OUT}$), determined with respect to said target air/fuel ratio, by a process with comprises compensating said basic value by said current first compensation value and said second compensation value; and;

controlling said air/fuel ratio of said mixture supplied to said engine in accordance with said output value.

2. A method of air/fuel ratio control according to claim 1, in which said second compensation value is determined on the basis of a proportional component, an integral component and a differential component respectively established in accordance with a deviation from a target air/fuel ratio of an air/fuel ratio detected by the output of said oxygen concentration sensor.

3. A method of air/fuel ratio control according to claim 2, in which each time said first compensation value is computed, said integral component is compensated in accordance with said current first compensation value and said preceding first compensation value.

4. A method of air/fuel ratio control according to claim 2, in which said first compensation value $K_{REF}$ is a first compensation coefficient and and in which said second compensation value ($K_{O2}$) is a second compensation coefficient, and in which said computation of said output value comprises multiplying said basic value by said first and second compensation coefficients.

5. A method of air/fuel ratio control for an internal combustion engine equipped with an oxygen concentration sensor disposed in an exhaust system for producing an output varying in proportion to an oxygen concentration in an exhaust gas of said engine, comprising:

setting a basic value ($T_i$) for control of said air/fuel ratio, in accordance with a plurality of engine operating parameters relating to engine load;

detecting an air/fuel ratio of a mixture supplied to said engine, based on the output from said oxygen concentration sensor, and compensating said basic value in accordance with the results of said detection, to thereby determine an output value with respect to a target air/fuel ratio;

setting a transition compensation value when acceleration or deceleration of said engine is detected, in accordance with the degree of acceleration or deceleration, and compensating said basic value by said transition compensation value to thereby determine said output value and;

controlling the air/fuel ratio of a mixture supplied to said engine, in accordance with said output value;

wherein the improvement comprises:

correcting said transition compensation value by a second compensation value which is obtained by the deviation from a target air/fuel ratio of an air/fuel ratio detected from the output of said oxygen concentration sensor, when engine acceleration or deceleration is detected.

6. A method of air/fuel ratio control according to claim 5 in which, during engine acceleration, said transition compensation value is an acceleration increment value $T_{ACC}$ which is added to said basic value, and in which, during engine deceleration, said transition compensation value is a decrement value $T_{DEC}$ which is added to said basic value.

7. A method of air/fuel ratio control according to claim 5 in which, when engine deceleration is detected, said second compensation value is read out from a memory location of a data map, in accordance with a plurality of engine operating parameters which express a degree of acceleration or deceleration, said second compensation value being applied to correct said transition compensation value, and in which said second compensation value is updated by obtaining a new value for said second compensation value in accordance with the deviation from a target air/fuel ratio of an air/fuel ratio detected from the output of said oxygen concentration sensor, and writing said new value of the second compensation value into a memory location of a data map in accordance with a plurality of engine operating parameters which express a degree of acceleration or deceleration.

8. A method of air/fuel ratio control according to claim 5, in which said second compensation value ($K_{TREF}$) is a compensation coefficient which is multiplied by said transition compensation value.

* * * * *